US008652011B2

(12) United States Patent
VanElverdinghe et al.

(10) Patent No.: US 8,652,011 B2
(45) Date of Patent: Feb. 18, 2014

(54) FRAME STRUCTURE FOR A SAFETY ENCLOSURE FOR A RECREATIONAL STRUCTURE

(75) Inventors: Jeffry L. VanElverdinghe, Beaverton, OR (US); Craig Adams, Portland, OR (US)

(73) Assignee: CA06, LLC, Addison, TX (US)

( * ) Notice: Subject to any disclaimer, the term of this patent is extended or adjusted under 35 U.S.C. 154(b) by 664 days.

(21) Appl. No.: 11/456,556

(22) Filed: Jul. 10, 2006

(65) Prior Publication Data

US 2008/0009394 A1 Jan. 10, 2008

(51) Int. Cl.
*A63B 5/11* (2006.01)

(52) U.S. Cl.
USPC ..... 482/29

(58) Field of Classification Search
USPC ..... 482/27–29
See application file for complete search history.

(56) References Cited

U.S. PATENT DOCUMENTS

| | | | | |
|---|---|---|---|---|
| D187,138 | S | 2/1960 | Highberger | |
| 3,201,126 | A | 8/1965 | Nissen | |
| 3,339,925 | A | 9/1967 | Nissen | |
| 4,433,838 | A | 2/1984 | Gordon | |
| 4,569,515 | A | 2/1986 | Gordon | |
| 4,605,204 | A * | 8/1986 | Schmanski et al. | 256/19 |
| 4,623,126 | A | 11/1986 | Pettit | |
| 4,900,011 | A | 2/1990 | Nolet | |
| 5,102,103 | A | 4/1992 | Putnam | |
| 5,395,105 | A | 3/1995 | Thommen, Jr. | |
| 5,399,132 | A | 3/1995 | Bailey | |
| 5,402,988 | A * | 4/1995 | Eisele | 256/24 |
| D382,618 | S | 8/1997 | Gift | |
| 5,664,769 | A * | 9/1997 | Sadinsky et al. | 256/73 |
| 5,941,798 | A | 8/1999 | Coan et al. | |
| 6,053,845 | A | 4/2000 | Publicover et al. | |
| 6,261,207 | B1 * | 7/2001 | Publicover et al. | 482/27 |
| 6,663,538 | B2 * | 12/2003 | Yoon | 482/27 |
| 7,494,444 | B2 * | 2/2009 | Adams | 482/27 |
| 2002/0137598 | A1 * | 9/2002 | Publicover et al. | 482/27 |
| 2005/0079954 | A1 | 4/2005 | Wang et al. | |
| 2005/0143225 | A1 | 6/2005 | Adams | |
| 2006/0128529 | A1 | 6/2006 | Adams | |

* cited by examiner

*Primary Examiner* — Oren Ginsberg
(74) *Attorney, Agent, or Firm* — Thompson & Knight LLP; James J. Murphy

(57) ABSTRACT

A frame structure for a safety enclosure for a recreational structure includes at least one substantially rigid horizontal support member, at least one vertical pole member having a top end, a substantially vertical portion and portion that is not substantially vertical, and at least one end cap member. The end cap member mates with the top end of the vertical pole member and releasably receiving a horizontal support member. In one exemplary embodiment, the vertical pole member can be part of a safety enclosure. In another exemplary embodiment, at least one horizontal support member is flexibly rigid. One exemplary embodiment provides a netting-type material that is attached to one of a horizontal support member and an end cap member, such that the netting-type material forms a substantially cylindrical shaped safety enclosure space.

16 Claims, 29 Drawing Sheets

FRAME STRUCTURE FOR A SAFETY ENCLOSURE FOR A RECREATIONAL STRUCTURE

BACKGROUND

The subject matter disclosed herein relates to recreational structures. More particularly, the subject matter disclosed herein relates to a frame structure for a safety enclosure for a recreational structure.

As used herein, the word "exemplary" means "serving as an example, instance, or illustration." Any embodiment or configuration described herein as "exemplary" is not necessarily to be construed as preferred or advantageous over other embodiments.

BRIEF SUMMARY

The subject matter disclosed herein provides a frame structure for a safety enclosure for a recreational structure that includes at least one substantially rigid horizontal support member, at least one vertical pole member having a top end, a substantially vertical portion and portion that is not substantially vertical, and at least one end cap member mating with the top end of the vertical pole member and releasably receiving a horizontal support member. In one exemplary embodiment, the vertical pole member can be part of a safety enclosure. In another exemplary embodiment, at least one horizontal support member is flexibly rigid. In still another exemplary embodiment, at least one end cap member is integral with the top end of at least one vertical pole member. One exemplary embodiment provides a netting-type material that is attached to one of a horizontal support member and an end cap member, such that the netting-type material forms a substantially cylindrical shaped safety enclosure space.

The subject matter disclosed herein also provides a frame structure for a safety enclosure for a recreational structure that includes at least one substantially rigid horizontal support member, at least one vertical pole member having a top end and releasably receiving a horizontal support member, and a netting-type material attached to one of a horizontal support member and an end cap member, such that the netting-type material forms a substantially cylindrical shaped safety enclosure space. One exemplary embodiment provides that the horizontal support member is releasably received by an aperture in the vertical pole member.

One exemplary embodiment provides that at least one end cap member includes a slot that releasably receives a horizontal support member. One exemplary embodiment provides that the slot is substantially on a top portion of the end cap member, while another exemplary embodiment provides that the slot is substantially on a side portion of the end cap member. Another exemplary embodiment provides at least one end cap member that includes an aperture that releasably receives a horizontal support member. Yet another exemplary embodiment provides at least one end cap member includes a side attachment member that releasably receives a horizontal support member. In one exemplary embodiment, the side attachment member is shaped substantially like an open ring, while for another exemplary embodiment, the side attachment member is shaped substantially like a closed ring. One exemplary embodiment provides at least one end cap member that includes a side attachment member that releasably receives a coupling member that is coupled to a horizontal support member. Still another exemplary embodiment provides at least one end cap member that includes a top attachment member that releasably receives a horizontal support member. Yet another exemplary embodiment provides at least one end cap member that includes an aperture that receives a coupling member that is coupled to a horizontal support member. One exemplary embodiment provides at least one end cap member that includes a slot member that releasably receives a horizontal support member and a cap portion that fits over a horizontal support member that has been received by the slot member.

Still another exemplary embodiment further includes an attachment device, such that at least one end cap member includes a recessed portion adapted to receive the attachment device that is coupled a horizontal support member to the end cap member. The attachment device can be, for example, an elastic cord, a bungee cord, a cord, a rope, a strap and/or a flexible webbing. Yet another exemplary embodiment further includes an attachment device such that at least one end cap member includes a recessed portion adapted to receive the attachment device that releasably couples a horizontal support member to the end cap member. The attachment device can be, for example, an elastic cord, a bungee cord, a cord, a rope, a strap and/or a flexible webbing.

BRIEF DESCRIPTION OF THE DRAWINGS

The subject matter disclosed herein is illustrated by way of example and not by limitation in the accompanying figures in which like reference numerals indicate similar elements and in which.

DETAILED DESCRIPTION

Figure 1A:
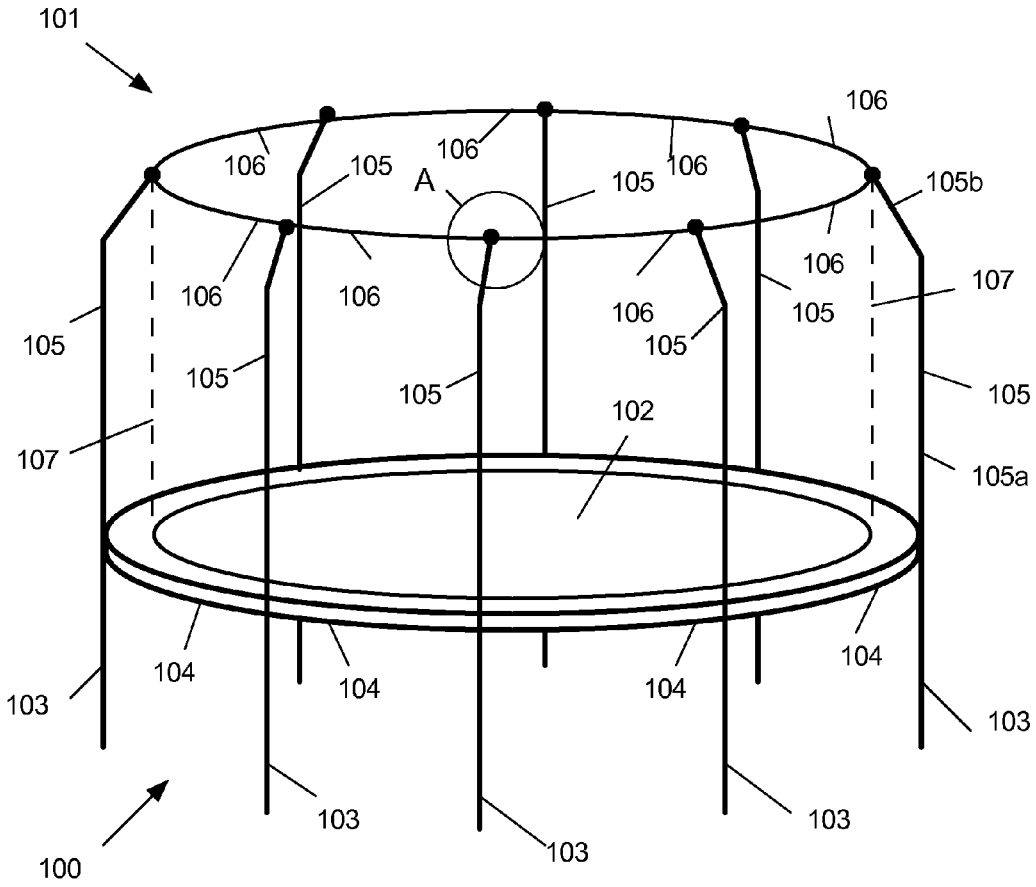
FIGS. 1A and 1B depict a perspective view of two exemplary trampolines having an exemplary safety enclosures.

FIG. 1A depicts a perspective view of a first exemplary trampoline 100 having an exemplary safety enclosure 101. Trampoline 100 includes a rebounding surface 102 and a frame structure having vertical frame members 103 and a circular frame that can be formed from a plurality of perimeter frame members 104. Vertical frame members 103 and perimeter frame members 104 are typically made from hollow metal tubing having sufficient strength and durability to bear the stresses and loads that are associated with trampolines. Safety enclosure 101 includes a frame structure having vertical pole members 105 and horizontal support members 106. According to one aspect of the subject matter disclosed herein, vertical pole members 105 have a substantially vertical portion 105*a* and a bent portion 105*b* that is not substantially vertical. In one exemplary embodiment, bent portion 105*b* angles from vertical portion 105 by between about 5 degrees and about 20 degrees depending upon the relative lengths of vertical portion 105*a* and bent portion 105*b* so that a fabric mesh- or netting-type of material, the outline of which is depicted by dashed lines 107, forms a substantially cylindrically shaped fence around rebounding surface 102 in order to keep a user on trampoline 100 and reduce the risk of injury to the user. A horizontal support member 106 is connected between adjacent vertical pole members 105 as described herein. A plurality of horizontal support members 106 are typically coupled together in a well-known manner to form a continuous circular or polygonal horizontal support structure at the top or near the top of vertical pole members 105.

According to the subject matter disclosed herein, one exemplary embodiment of a horizontal support member 106 is substantially rigid. Another exemplary embodiment of a horizontal support member 106 is flexibly rigid. One example of a structural member that is suitable for both vertical pole members 105 and horizontal support members 106 is disclosed by U.S. Pat. No. 6,450,187 B1 to Lin et al., which is incorporated by reference herein. Thus, the horizontal support members 106 can be independently bendable and resiliently flexible to resist bending. Another example of a structural member that is suitable for both vertical pole members 105 and horizontal support members 106 is a metal tube formed from, for example, aluminum, steel or other metal alloy. Yet another example of a suitable structural member formed from plastic, carbon fiber or wood having dimensions and physical properties suitable for withstanding the stresses associated with trampolines and other such recreational structures. While a plurality of horizontal support member 106 have been described as being used, it should be understood that a single continuous horizontal support member 106 could be used or a single horizontal support structure 106 having two ends that are coupled together in a well-known manner could be used.

Figure 1B:
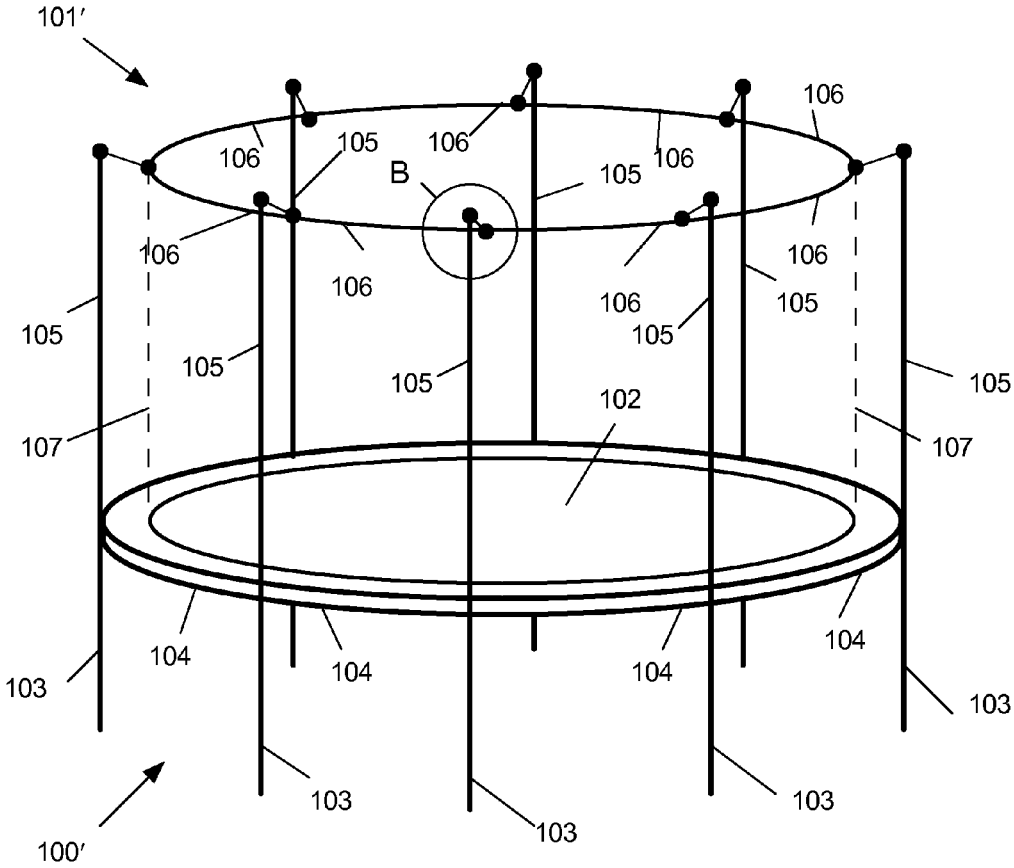

FIG. 1B depicts a perspective view of a second exemplary trampoline 100' having an exemplary safety enclosure 101'. Exemplary trampoline 100' and safety enclosure 101' in FIG. 1B are similar in many respects to trampoline 100 and safety enclosure 101 in FIG. 1A. One difference between trampoline 100' and safety enclosure 101' in FIG. 1B and trampoline 100 and safety enclosure 101 in FIG. 1A is that vertical pole members 105 for safety enclosure 101' are substantially vertical without a bent portion 105*b*.

Complete details of trampoline 100, safety enclosure 101, trampoline 100' and safety enclosure 101' are not shown in FIGS. 1A and 1B for simplicity. For example, safety enclosure 101 includes a fabric mesh- or netting-type of material (depicted only as an outline by dashed lines 107) that extends between adjacent vertical pole members 105 and between horizontal frame members 106 and circular frame member 104 that together with circular frame 104, vertical pole members 105 and horizontal support members 106 operate as a fence around rebounding surface 102 in order to keep a user on trampoline 100 and reduce the risk of injury to the user.

According to the subject matter disclosed herein, vertical pole members 105 of safety enclosure 101 attach to or pass through the horizontal support members 106 using a plurality of end cap members, one of which is indicated at A in FIG. 1A and one of which is indicated at B in FIG. 1B, and provide a safety enclosure 101 in which the entire top of safety enclosure 101 is at substantially the same height. Accordingly, the fabric mesh- or netting-type material (not shown) can be fastened to horizontal support member 106 in a well-known manner so that the entire top of the fabric mesh- or netting-type material is at substantially the same height. Further, the fabric mesh- or netting-type material is coupled between the top of the safety enclosure and the rebounding surface to substantially form a cylindrical shape in order to keep a user on trampoline 100 and reduce the risk of injury to the user.

Figure 2A:
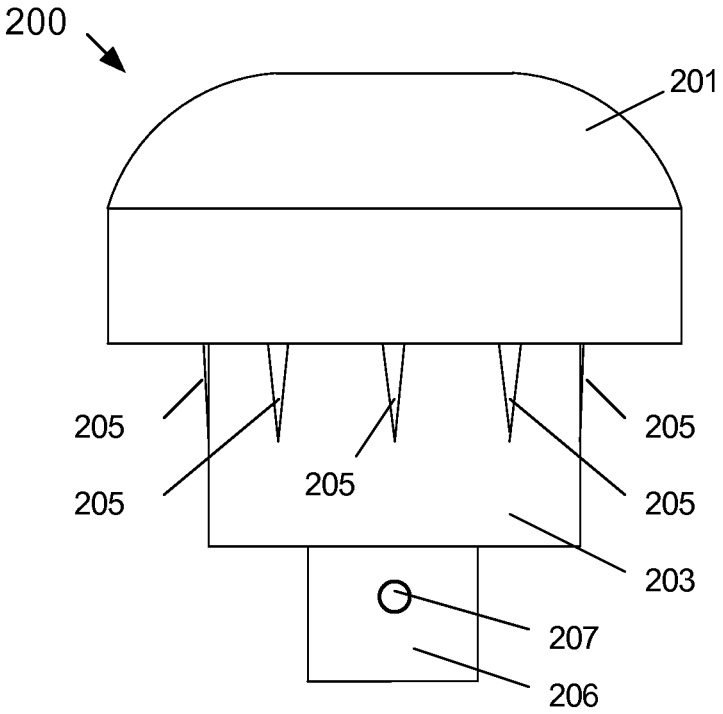
FIGS. 2A-2D depict a first exemplary embodiment of an end cap member according to the subject matter disclosed herein.
Figure 2B:
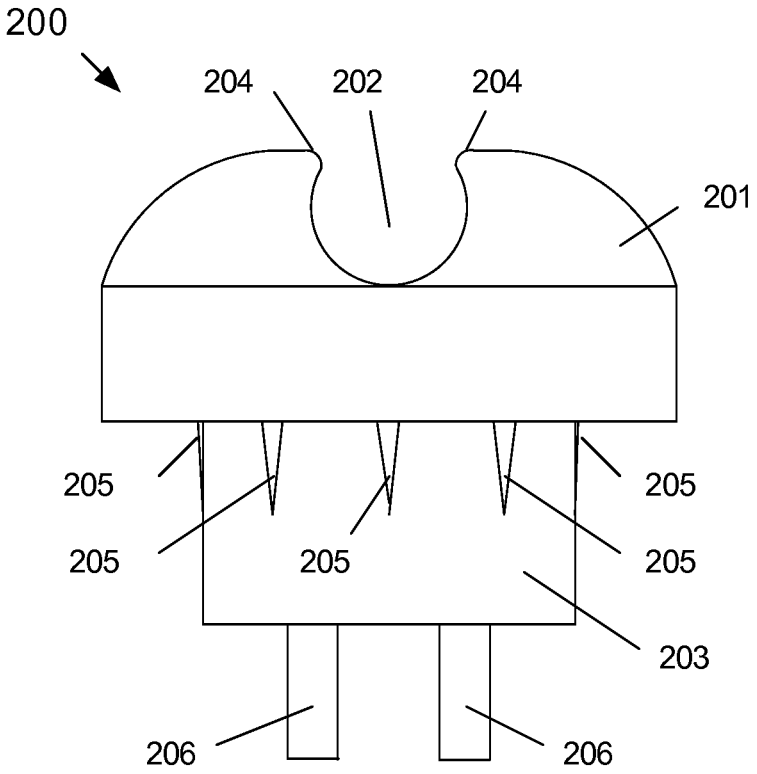
Figure 2C:
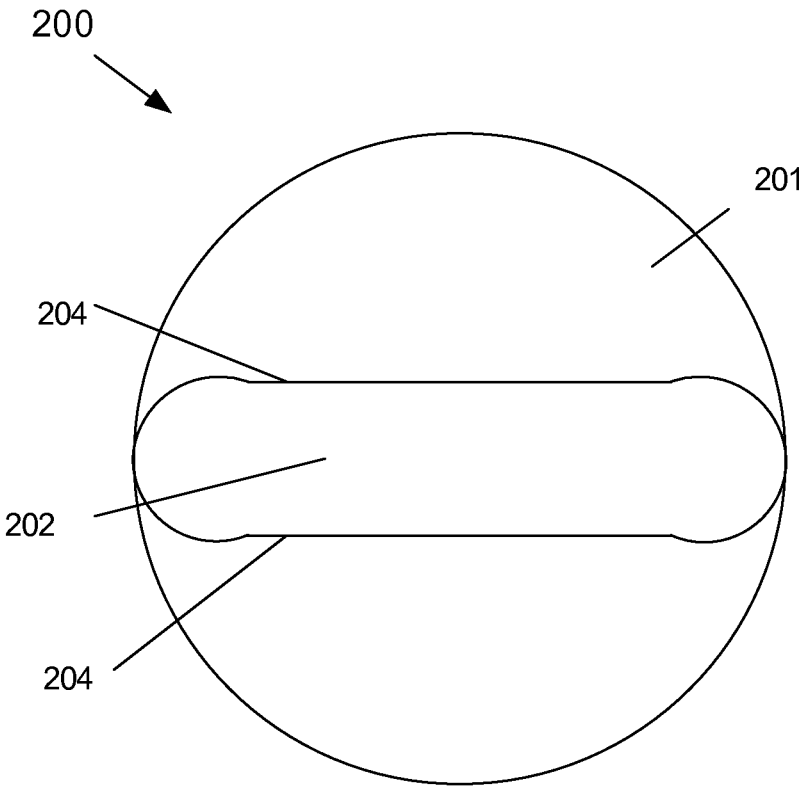
Figure 2D:
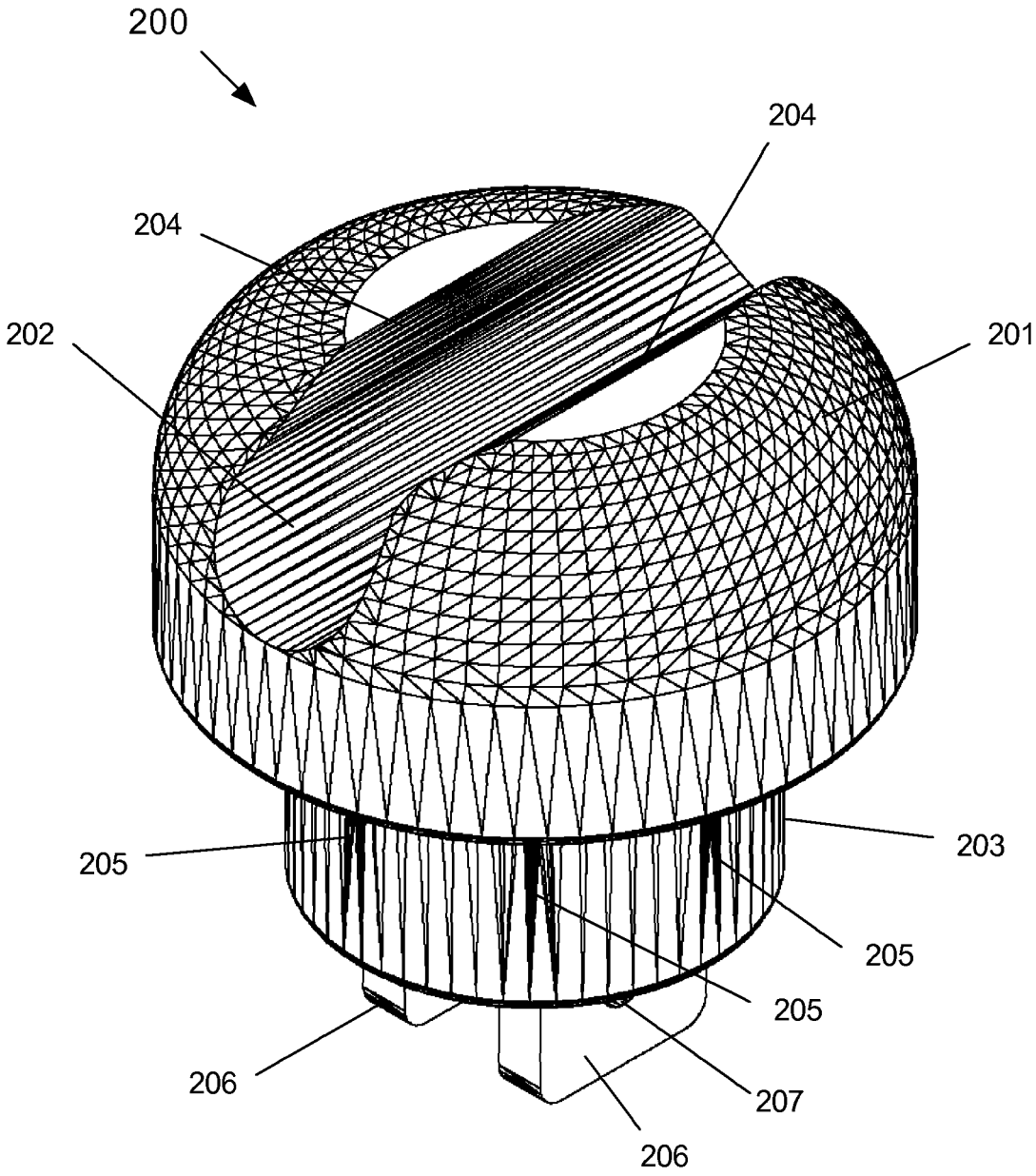

FIGS. 2A-2D depict a first exemplary embodiment of an end cap member 200 according to the subject matter disclosed herein. In particular, FIGS. 2A-2C respectively depict a first side view, a second side view and a top view of end cap member 200 that is suitable for use with, for example, a trampoline safety enclosure according to the subject matter disclosed herein. FIG. 2D depicts a three-dimensional (3-D) perspective view of end cap member 200. End cap member 200 includes a top portion 201 having a slot, or groove, 202, and a bottom portion 203. Bottom portion 203 fits inside a vertical pole member 105 (not shown in FIGS. 2A-2D).

Slot 202 provides a holding mechanism that releasably receives a horizontal support member 106 (not shown in FIGS. 2A-2D). As used herein, the phrases "releasably receives" and "releasably receiving" generally mean that during assembly of a safety enclosure, a horizontal support member can be assembled, or engaged, with a holding mechanism of an end cap member and the horizontal support member is held by the holding mechanism under normal circumstances. During disassembly of the safety enclosure, a horizontal support member can be disassembled, or disengaged, from the holding mechanism of the end cap member.

The cross-sectional shape of slot 202 corresponds to the cross-sectional shape of the particular horizontal support member 106 being used. For example, in FIGS. 2B-2D, the cross-sectional shape of slot 202 is substantially round and corresponds to a horizontal support member 106 that also has a substantially round cross-sectional shape. Slot 202 also includes edges 204 that are spaced apart a distance that is selected to be less that the diameter of a horizontal support member 106 so that a received horizontal support member 106 is held in slot 202. It should be understood that slot 202 could have other cross-sectional shapes that accordingly correspond to the cross-sectional shape of the particular horizontal support member 106 being used.

Bottom portion 203 is depicted in FIGS. 2A, 2B and 2D as being substantially cylindrical in shape in order to mate with vertical pole member 105 having a substantially round cross-sectional shape by fitting inside the vertical pole member. Bottom portion 203 includes sloped ridges 205 that enable a convenient and affirmative press-fit or friction-fit mating between bottom portion 203 and the inside of a vertical pole member 105. It should be understood that bottom portion 203 could have other cross-sectional shapes that accordingly correspond to the cross-sectional shape of the particular vertical pole member that is being used. In an alternative exemplary embodiment, the size and shape of bottom portion 203 could be selected to fit over the end of a vertical pole member 105 as opposed to fitting inside the vertical pole member 105. In one exemplary embodiment, bottom portion 203 also includes one or more tabs 206 having at least one aperture 207 that can be used for further securing end cap member 200 to a vertical pole member 105, such as by a bolt and nut arrangement or the like, and/or be used for attaching a tension member, such as disclosed in U.S. patent application Ser. No. 10/908,469, filed May 12, 2005, entitled "Recreational " Structure Using A Sleeve-Joint Coupling, and which is incorporated by reference herein . In one exemplary embodiment, such a tension member would extend through a vertical pole member 105 and be anchored, for example, to the ground in a well-known manner.

Figure 3A:
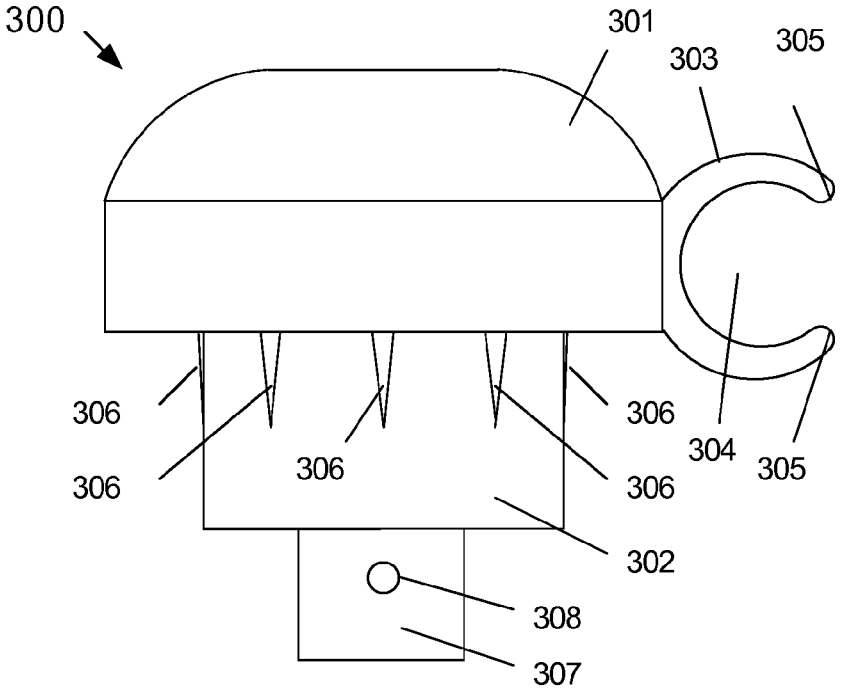
FIGS. 3A-3C depict a second exemplary embodiment of an end cap member according to the subject matter disclosed herein.
Figure 3B:
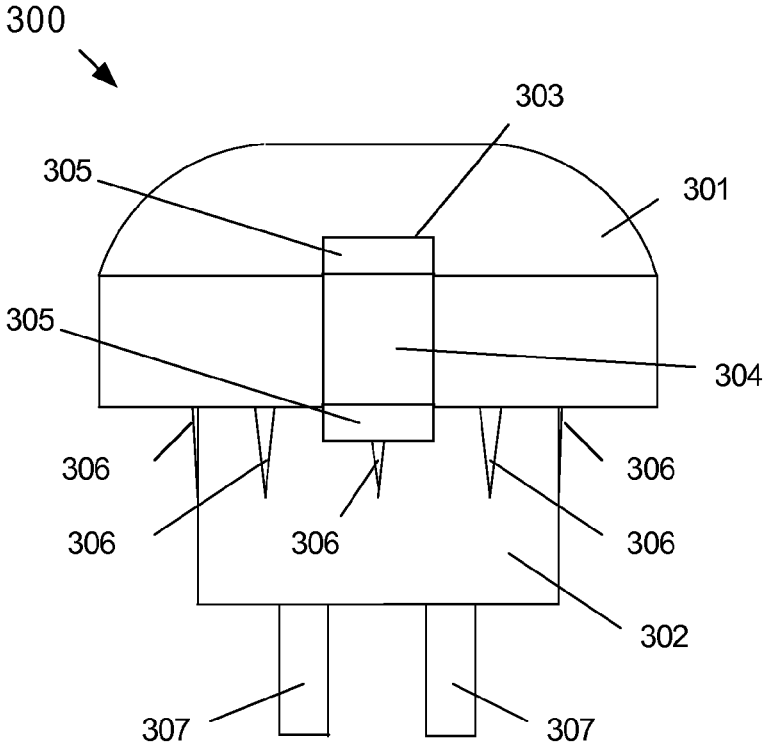
Figure 3C:
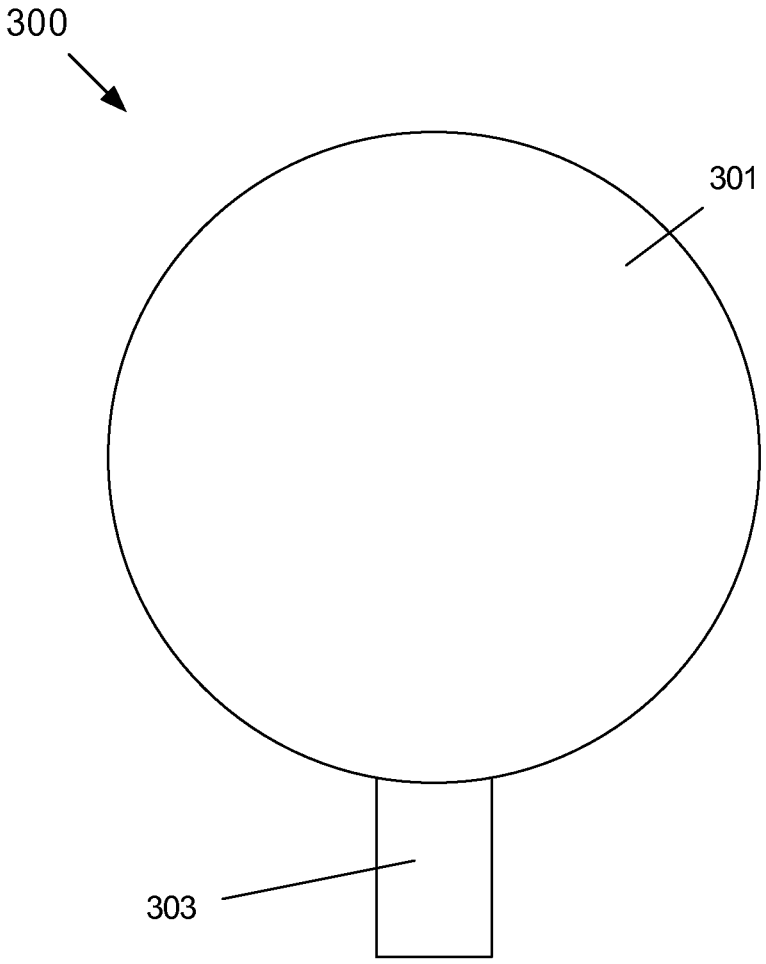

FIGS. 3A-3C depict a second exemplary embodiment of an end cap member 300 according to the subject matter disclosed herein. In particular, FIGS. 3A-3C respectively depict a first side view, a second side view and a top view of an end cap member 300 that is suitable for use with, for example, a trampoline safety enclosure according to the subject matter disclosed herein. End cap member 300 includes a top portion 301, a bottom portion 302 and a side attachment member 303 shaped substantially like an open ring that functions as a holding mechanism. Side attachment member 303 releasably receives a horizontal support member 106 (not shown in FIGS. 3A-3C) in space 304.

Space 304 of side attachment member 303 is shaped to correspond to the cross-sectional shape of a horizontal support member 106 and includes edges 305 that are spaced apart a distance that is less that the diameter of a horizontal support member 106 so that a received horizontal support member 106 is held in space 304 by side attachment member 303 and edges 305. As depicted in FIGS. 3A-3C, space 304 generally has a substantially round cross-sectional shape. It should be understood that other cross-sectional shapes could be used that accordingly correspond to the cross-sectional shape of the particular horizontal support member that is being used. While side attachment member 303 is depicted as being substantially oriented for releasably receiving a portion of a horizontal support member 106 or a coupling member attached to a horizontal support member 106, it should be understood that side attachment member 303 could be oriented to releasably receive a portion of horizontal support member that is not oriented substantially horizontally or another coupling member that is coupled to a horizontal support member. Further, while side attachment member 303 is depicted as being oriented in a substantially horizontal radial direction from top portion 301, it should be understood that side attachment member 303 could be oriented from top portion 301 in a direction that is different from a substantially horizontal radial direction.

Bottom portion 302 is depicted in FIGS. 3A and 3B as being substantially cylindrical in shape in order to mate with a vertical pole member 105 having a substantially round cross-sectional shape by fitting inside the vertical pole member. Bottom portion 302 includes sloped ridges 306 that enable a convenient and affirmative press-fit or friction-fit mating between bottom portion 302 and the inside of a vertical pole member 105. It should be understood that bottom portion 302 could have other cross-sectional shapes that accordingly correspond to the cross-sectional shape of the particular vertical pole member that is being used. In an alternative exemplary embodiment, the size and shape of bottom portion 302 could be selected to fit over the end of a vertical pole member 105 as opposed to fitting inside the vertical pole member 105. In one exemplary embodiment, bottom portion 302 also includes one or more tabs 307 having at least one aperture 308 that can be used for further securing end cap member 300 to a vertical pole member 105, such as by a bolt and nut arrangement or the like, and/or be used for attaching a tension member, such as disclosed in U.S. patent application Ser. No. 10/908,469, filed May 12, 2005, entitled "Recreational " Structure Using A Sleeve-Joint Coupling, and which is incorporated by reference herein . In one exemplary embodiment, such a tension member would extend through a vertical pole member 105 and be anchored, for example, to the ground in a well-known manner.

Figure 4A:
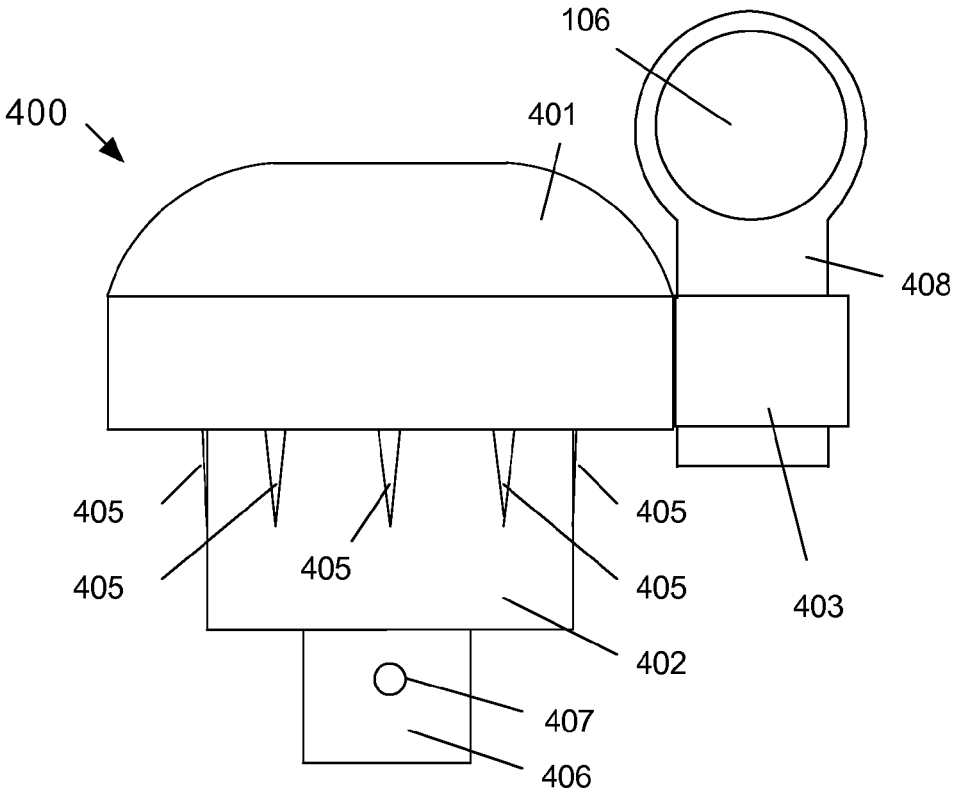
FIGS. 4A-4C depict a third exemplary embodiment of an end cap member according to the subject matter disclosed herein.
Figure 4B:
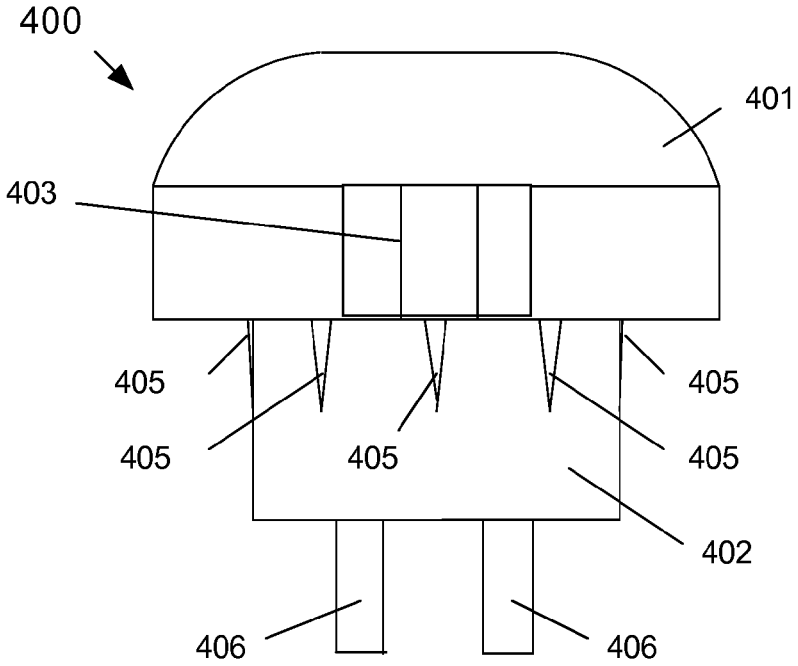
Figure 4C:
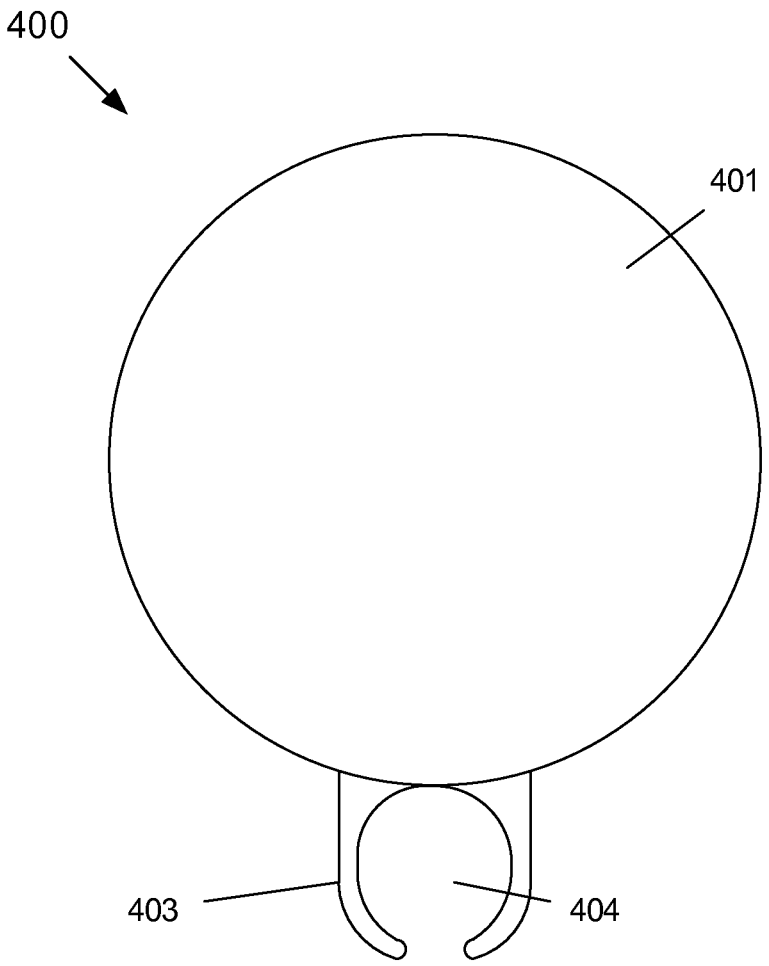

FIGS. 4A-4C depict a third exemplary embodiment of an end cap member 400 according to the subject matter disclosed herein. In particular, FIGS. 4A-4C respectively depict a first side view, a second side view and a top view of an end cap member 600 that is suitable for use with, for example, a trampoline safety enclosure according to the subject matter disclosed herein. End cap member 400 includes a top portion 401, a bottom portion 402 and a side attachment member 403 shaped substantially like an open ring that functions as a holding mechanism. Side attachment member 403 releasably receives a coupling member 408 that, in turn, receives a horizontal support member 106 (FIG. 4A) in space 604 (FIG. 4C). In an alternative exemplary embodiment, coupling member 408 is integral with side attachment member 403. Coupling member 408 could be oriented substantially upward, as depicted in FIG. 4A. Alternatively, coupling member could be oriented substantially downward. Further coupling member 408 could be oriented in a direction that is different from substantially upward or substantially downward. In one exemplary embodiment coupling member 408 is separate from horizontal support member 106 and releasably receives the horizontal support member. In another exemplary embodiment, coupling member 408 is integral to horizontal support member 106.

Space 404 in side attachment member 403 is shaped to correspond to the cross-sectional shape of coupling member 408 so that a horizontal support member 106 is held by side attachment member 403. As depicted in FIG. 4C, space 404 generally has a round cross-sectional shape. It should be understood that side attachment member 403 and space 404 could have other cross-sectional shapes that accordingly correspond to the cross-sectional shape of the particular coupling member 408 that is being used. While side attachment member 403 is depicted as being substantially oriented for releasably receiving a coupling member having a longitudinal axis oriented substantially vertically, it should be understood that side attachment member 403 could be oriented to releasably receive a coupling member having a longitudinal axis that is not oriented substantially vertically. Further, while side attachment member 403 is depicted as being oriented in a substantially horizontal radial direction from top portion 401, it should be understood that side attachment member 403 could be oriented from top portion 401 in a direction that is different from a substantially horizontal radial direction.

Bottom portion 402 is depicted in FIGS. 4A and 4B as being substantially cylindrical in shape in order to mate with a vertical pole member 105 having a substantially round cross-sectional shape by fitting inside the vertical pole member. Bottom portion 402 includes sloped ridges 405 that enable a convenient and affirmative press-fit or friction-fit mating between bottom portion 402 and the inside of a vertical pole member 105. It should be understood that other cross-sectional shapes could be used that accordingly correspond to the cross-sectional shape of the vertical pole member that is being used. In an alternative exemplary embodiment, the size and shape of bottom portion 402 could be selected to fit over the end of a vertical pole member 105. In one exemplary embodiment, bottom portion 402 also includes one or more tabs 406 having at least one aperture 407 that can be used for further securing end cap member 400 to a vertical pole member 105, such as by a bolt and nut arrangement or the like, and/or be used for attaching a tension member, such as disclosed in U.S. patent application Ser. No. 10/908,469, filed May 12, 2005, entitled "Recreational " Structure Using A Sleeve-Joint Coupling, and which is incorporated by reference herein . In one exemplary embodiment, such a tension member would extend through a vertical pole member 105 and be anchored, for example, to the ground in a well-known manner.

Figure 5A:
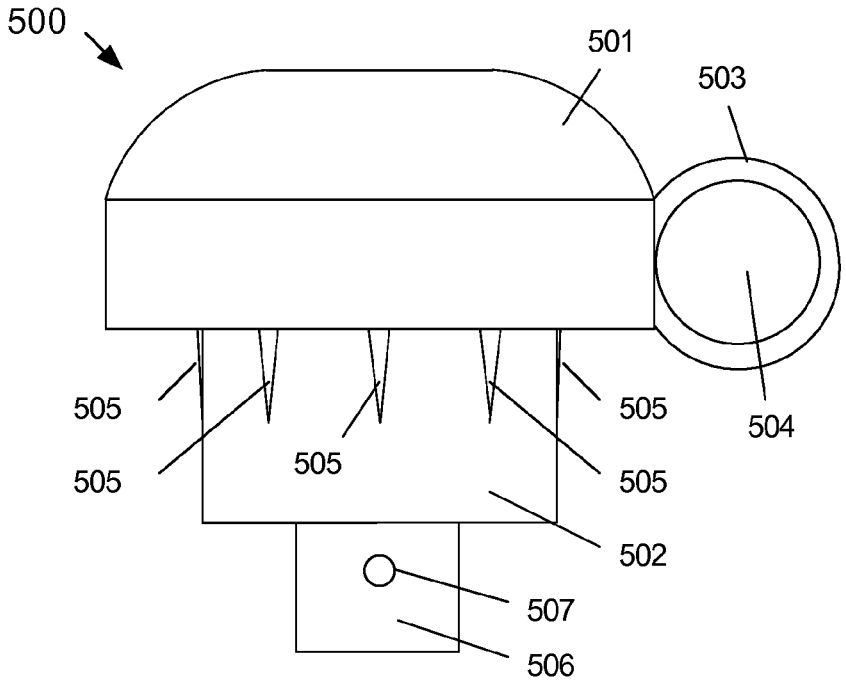
FIGS. 5A-5C depict a fourth exemplary embodiment of an end cap member according to the subject matter disclosed herein.
Figure 5B:
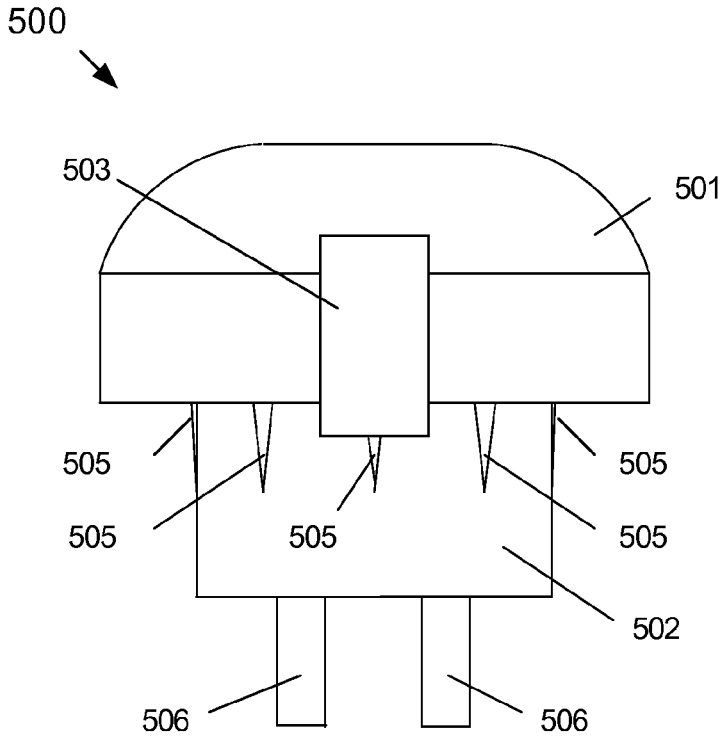
Figure 5C:
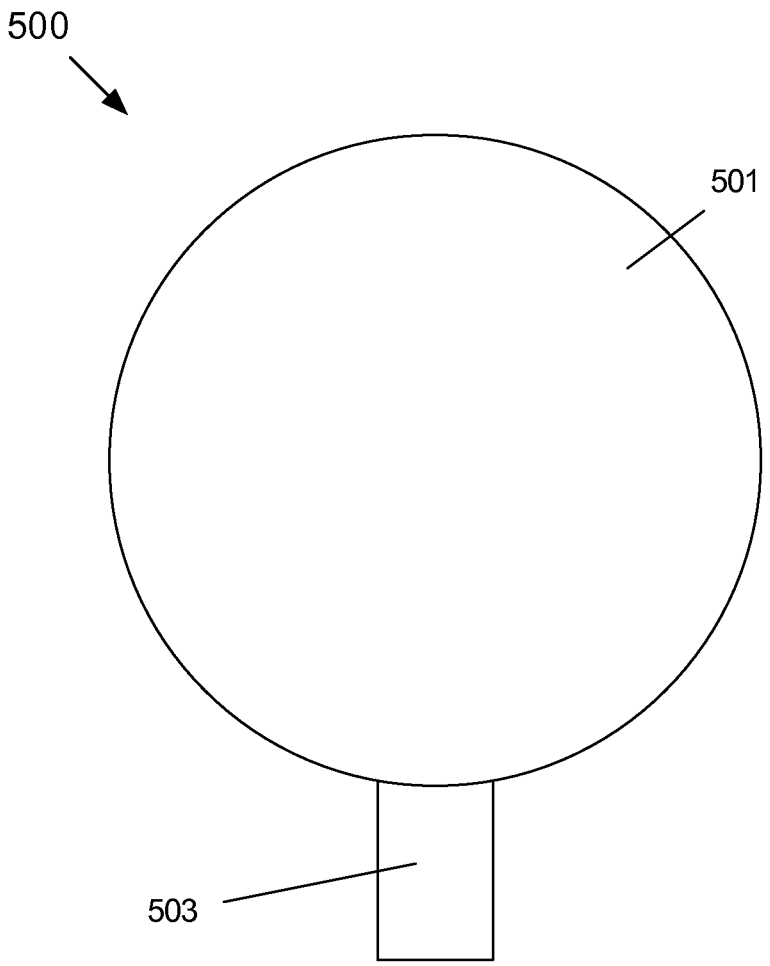

FIGS. 5A-5C depict a fourth exemplary embodiment of an end cap member 500 according to the subject matter disclosed herein. In particular, FIGS. 5A-5C respectively depict a first side view, a second side view and a top view of an end cap member 500 that is suitable for use with, for example, a trampoline safety enclosure according to the subject matter disclosed herein. End cap member 500 includes a top portion 501, a bottom portion 502 and a side attachment member 503 shaped substantially like a closed ring that functions as a holding mechanism. Side attachment member 503 releasably receives a horizontal support member 106 (not shown in FIGS. 5A-5C) in space 504.

Space 504 in side attachment member 503 is shaped to correspond to the cross-sectional shape of a horizontal support member 106 and so that a received horizontal support member 106 is held in space 504 by side attachment member 503. As depicted in FIGS. 5A-5C, space 504 generally has a round cross-sectional shape. It should be understood that side attachment member 503 and space 504 could have other cross-sectional shapes that accordingly correspond to the cross-sectional shape of the particular horizontal support member that is being used. While side attachment member 503 is depicted as being substantially oriented for releasably receiving a portion of a horizontal support member 106, it should be understood that side attachment member 503 could be oriented to releasably receive a portion of horizontal support member that is not oriented substantially horizontally or another member that is coupled to a horizontal support member. Further, while side attachment member 503 is depicted as being oriented in a substantially horizontal radial direction from top portion 501, it should be understood that side attachment member 503 could be oriented from top portion 501 in a direction that is different from a substantially horizontal radial direction.

Bottom portion 502 is depicted in FIGS. 5A and 5B as being substantially cylindrical in shape in order to mate with a vertical pole member 105 having a substantially round cross-sectional shape by fitting inside the vertical pole member. Bottom portion 502 includes sloped ridges 505 that enable a convenient and affirmative press-fit or friction-fit mating between bottom portion 502 and the inside of a vertical pole member 105. It should be understood that other cross-sectional shapes could be used that accordingly correspond to the cross-sectional shape of the vertical pole member that is being used. In an alternative exemplary embodiment, the size and shape of bottom portion 502 could be selected to fit over the end of a vertical pole member 105. In one exemplary embodiment, bottom portion 502 also includes one or more tabs 506 having at least one aperture 407 that can be used for further securing end cap member 500 to a vertical pole member 105, such as by a bolt and nut arrangement or the like, and/or be used for attaching a tension member, such as disclosed in U.S. patent application Ser. No. 10/908,469, filed May 12, 2005, entitled "Recreational " Structure Using A Sleeve-Joint Coupling, and which is incorporated by reference herein . In one exemplary embodiment, such a tension member would extend through a vertical pole member 105 and be anchored, for example, to the ground in a well-known manner.

Figure 6A:
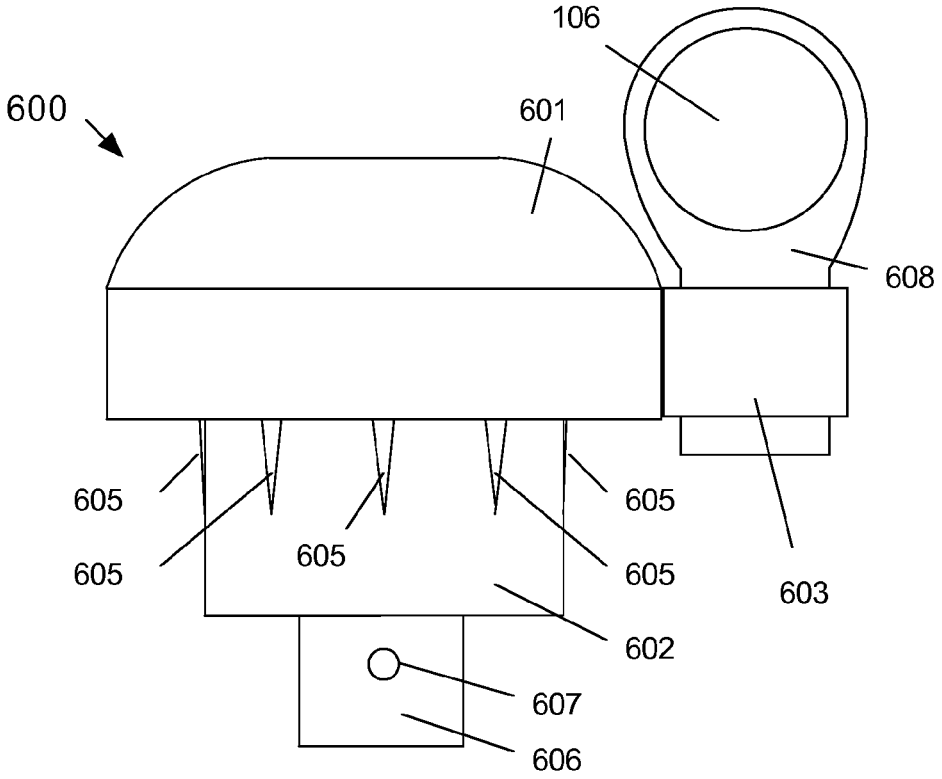
FIGS. 6A-6C depict a fifth exemplary embodiment of an end cap member according to the subject matter disclosed herein.
Figure 6B:
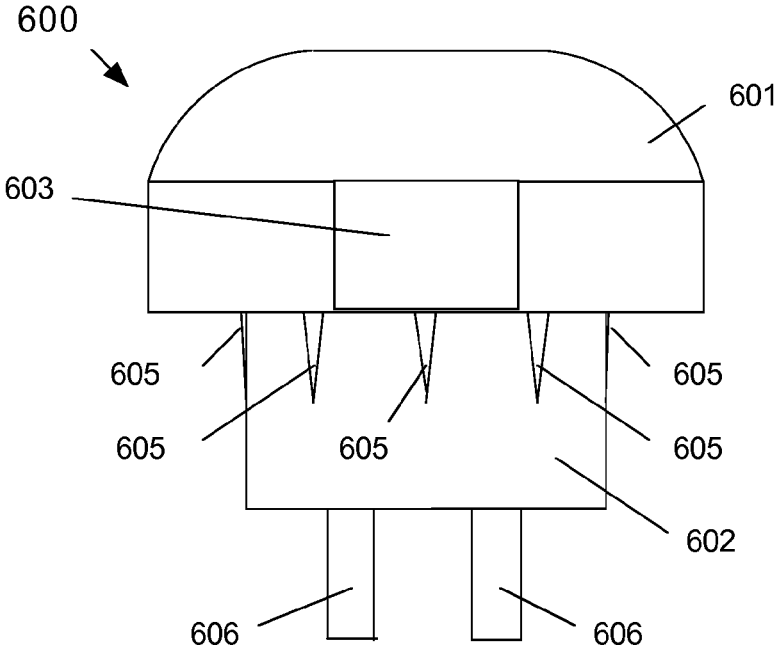
Figure 6C:
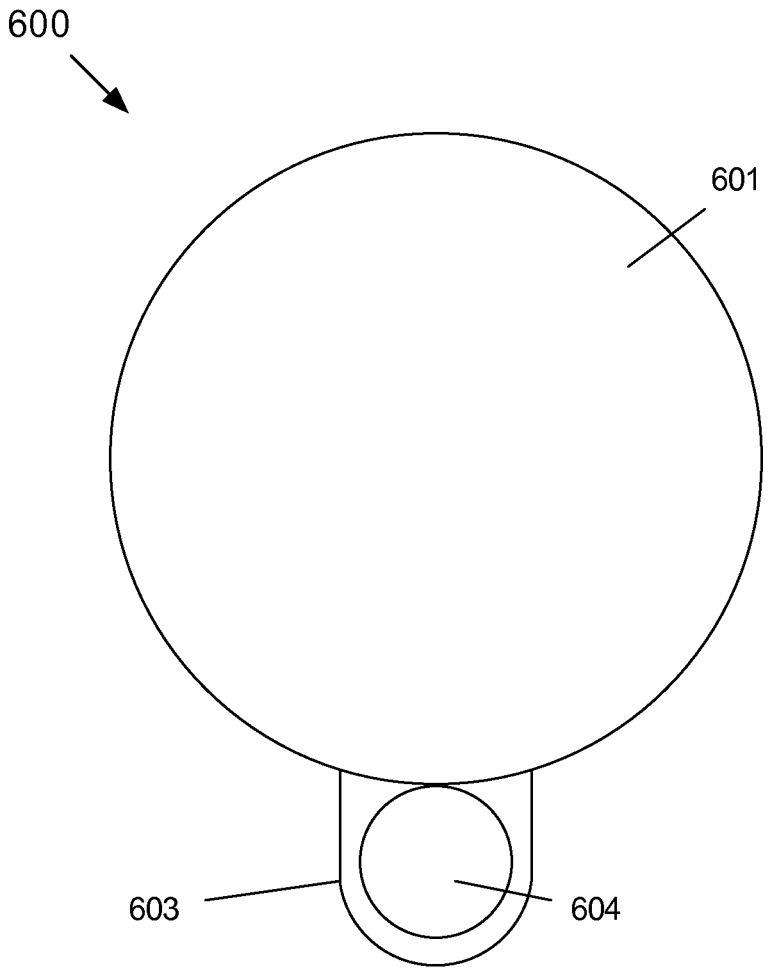

FIGS. 6A-6C depict a fifth exemplary embodiment of an end cap member 600 according to the subject matter disclosed herein. In particular, FIGS. 6A-6C respectively depict a first side view, a second side view and a top view of an end cap member 600 that is suitable for use with, for example, a trampoline safety enclosure according to the subject matter disclosed herein. End cap member 600 includes a top portion 601, a bottom portion 602 and a side attachment member 603 shaped substantially like a closed ring that functions as a holding mechanism. Side attachment member 603 releasably receives a coupling member 608 that, in turn, receives a horizontal support member 106 (FIG. 6A) in space 604 (FIG. 6C). In an alternative exemplary embodiment, coupling member 408 is integral with side attachment member 403. Coupling member 608 could be oriented substantially upward, as depicted in FIG. 6A. Alternatively, coupling member could be oriented substantially downward. Further coupling member 608 could be oriented in a direction that is different from substantially upward or substantially downward. In one exemplary embodiment coupling member 608 is separate from horizontal support member 106 and releasably receives the horizontal support member. In another exemplary embodiment, coupling member 608 is integral to horizontal support member 106.

Space 604 in side attachment member 603 is shaped to correspond to the cross-sectional shape of coupling member 608 so that a horizontal support member 106 is held by side attachment member 603. As depicted in FIG. 6C, space 604 generally has a round cross-sectional shape. It should be understood that side attachment member 603 and space 604 could have other cross-sectional shapes that accordingly correspond to the cross-sectional shape of the particular coupling member 608 that is being used. While side attachment member 603 is depicted as being substantially oriented for releasably receiving a coupling member having a longitudinal axis oriented substantially vertically, it should be understood that side attachment member 603 could be oriented to releasably receive a coupling member having a longitudinal axis that is not oriented substantially vertically. Further, while side attachment member 603 is depicted as being oriented in a substantially horizontal radial direction from top portion 601, it should be understood that side attachment member 603 could be oriented from top portion 601 in a direction that is different from a substantially horizontal radial direction.

Bottom portion 602 is depicted in FIGS. 6A and 6B as being substantially cylindrical in shape in order to mate with a vertical pole member 105 having a substantially round cross-sectional shape by fitting inside the vertical pole member. Bottom portion 602 includes sloped ridges 605 that enable a convenient and affirmative press-fit or friction-fit mating between bottom portion 602 and the inside of a vertical pole member 105. It should be understood that other cross-sectional shapes could be used that accordingly correspond to the cross-sectional shape of the vertical pole member that is being used. In an alternative exemplary embodiment, the size and shape of bottom portion 602 could be selected to fit over the end of a vertical pole member 105. In one exemplary embodiment, bottom portion 602 also includes one or more tabs 606 having at least one aperture 607 that can be used for further securing end cap member 400 to a vertical pole member 105, such as by a bolt and nut arrangement or the like, and/or be used for attaching a tension member, such as disclosed in U.S. patent application Ser. No. 10/908,469, filed May 12, 2005, entitled "Recreational " Structure Using A Sleeve-Joint Coupling, and which is incorporated by reference herein. In one exemplary embodiment, such a tension member would extend through a vertical pole member 105 and be anchored, for example, to the ground in a well-known manner.

Figure 7A:
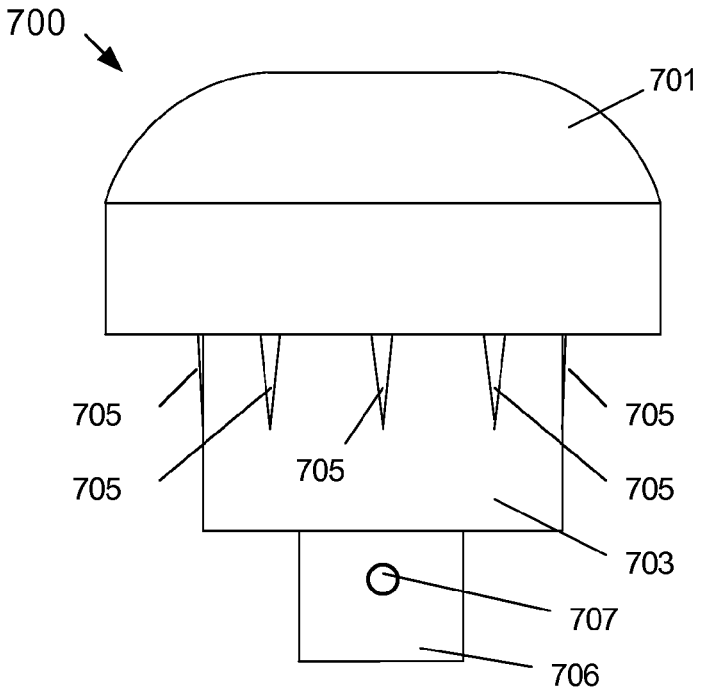
FIGS. 7A-7C depict a sixth exemplary embodiment of an end cap member according to the subject matter disclosed herein.
Figure 7B:
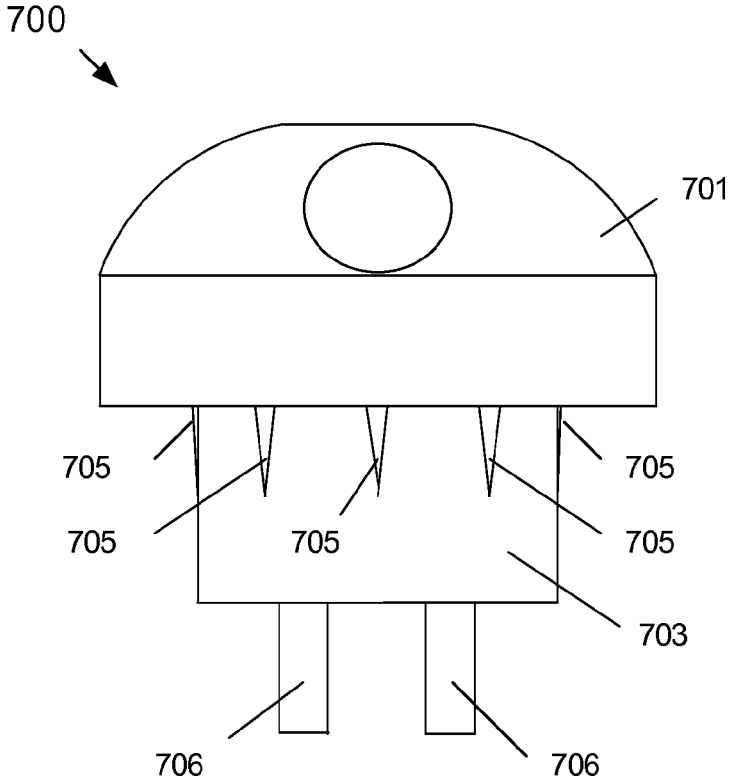
Figure 7C:
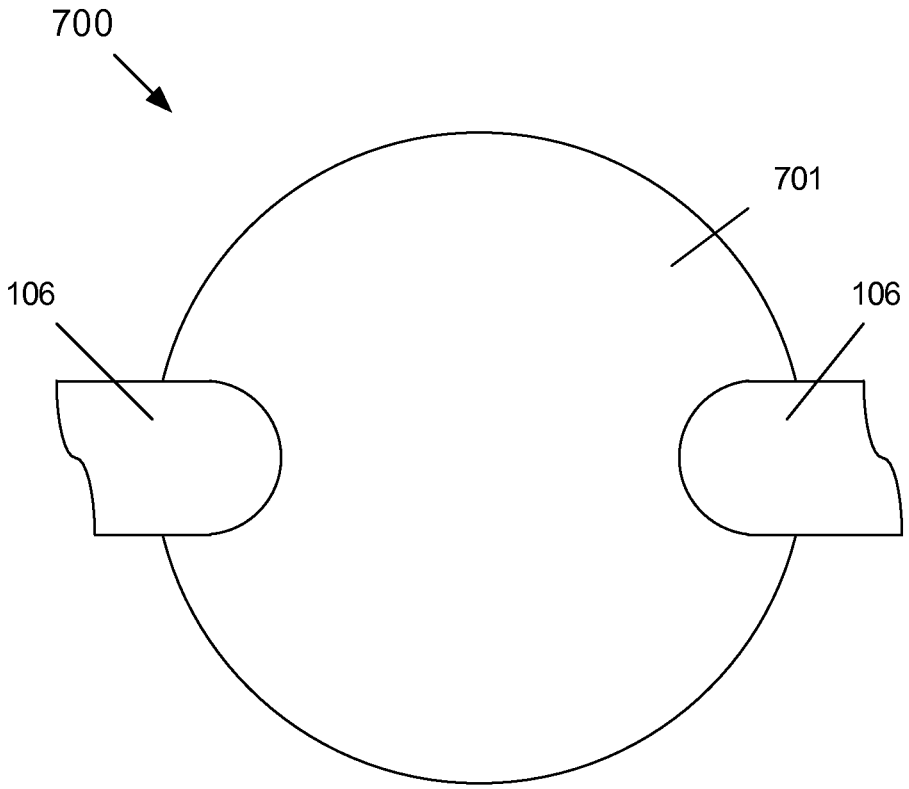

FIGS. 7A-7C depict a sixth exemplary embodiment of an end cap member 700 according to the subject matter disclosed herein. In particular, FIGS. 7A-7C respectively depict a first side view, a second side view and a top view of an end cap member 700 that is suitable for use with, for example, a trampoline safety enclosure according to the subject matter disclosed herein. End cap member 700 includes a top portion 701 having an aperture 702 that functions as a holding mechanism, and a bottom portion 703. Aperture 702 releasably receives a horizontal support member 106 (shown in FIG. 7C). That is, a horizontal support member 106 is fit through aperture 702 and is thereby securely held in place by aperture 702. Bottom portion 703 fits inside a vertical pole member 105 (not shown in FIGS. 7A and 7B).

The cross-sectional shape of aperture 702 corresponds to the cross-sectional shape of the particular horizontal support member 106 being used. As depicted in FIGS. 7A-7C, aperture 702 generally has a round cross-sectional shape. It should be understood, however, that other cross-sectional shapes, such as, but not limited to, square, triangular, oval and rectangular, could be used that accordingly correspond to the cross-sectional shape of the particular horizontal support member that is being used.

Bottom portion 703 is depicted in FIGS. 7A and 7B as being substantially cylindrical in shape in order to mate with a vertical pole member 105 having a substantially round cross-sectional shape by fitting inside the vertical pole member. Bottom portion 703 includes sloped ridges 705 that enable a convenient and affirmative press-fit or friction-fit mating between bottom portion 703 and the inside of a vertical pole member 105. It should be understood that other cross-sectional shapes could be used that accordingly correspond to the cross-sectional shape of the vertical pole member that is being used. In an alternative exemplary embodiment, the size and shape of bottom portion 703 could be selected to fit over the end of a vertical pole member 105. In one exemplary embodiment, bottom portion 703 also includes one or more tabs 706 having at least one aperture 707 that can be used for further securing end cap member 700 to a vertical pole member 105, such as by a bolt and nut arrangement or the like, and/or be used for attaching a tension member, such as disclosed in U.S. patent application Ser. No. 10/908,469, filed May 12, 2005, entitled "Recreational " Structure Using A Sleeve-Joint Coupling, and which is incorporated by reference herein. In one exemplary embodiment, such a tension member would extend through a vertical pole member 105 and be anchored, for example, to the ground in a well-known manner.

Figure 8A:
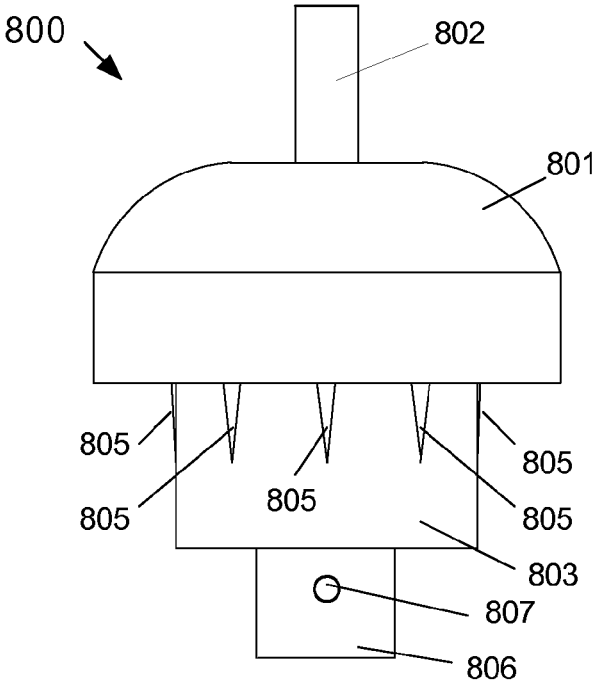
FIGS. 8A and 8B depict a seventh exemplary embodiment of an end cap member according to the subject matter disclosed herein.
Figure 8B:
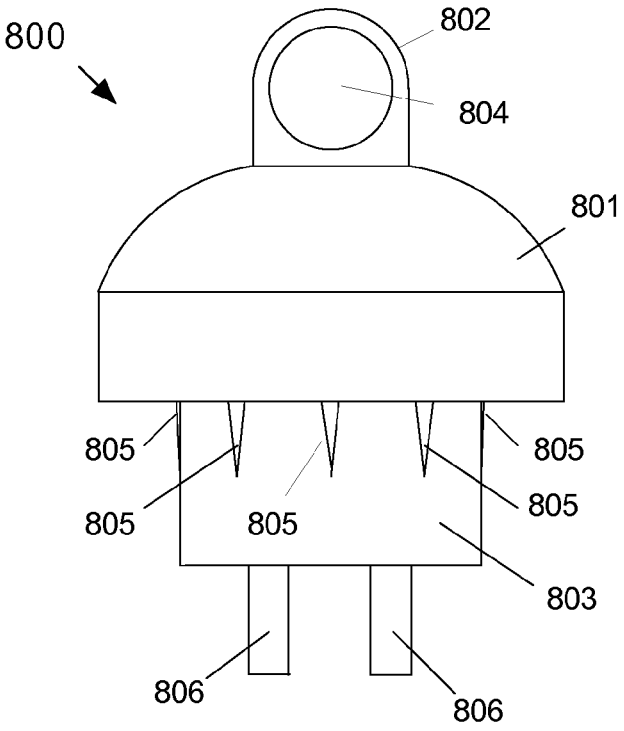

FIGS. 8A and 8B depict a seventh exemplary embodiment of an end cap member 800 according to the subject matter disclosed herein. In particular, FIGS. 8A and 8B respectively depict a first side view and a second side view of an end cap member 800 that is suitable for use with, for example, a trampoline safety enclosure according to the subject matter disclosed herein. End cap member 800 includes a top portion 801 having a top attachment member 802 that functions as a holding mechanism, and a bottom portion 803. Top attachment member 802 releasably receives a horizontal support member 106 (not shown in FIGS. 8A and 8B). That is, a horizontal support member 106 is fit through an aperture 804 in top attachment member 802 and is thereby held in place by top attachment member 802. Bottom portion 803 fits inside a vertical pole member 105 (not shown in FIGS. 8A and 8B).

The cross-sectional shape of aperture 804 corresponds to the cross-sectional shape of the particular horizontal support member 106 being used. As depicted in FIG. 8B, aperture 804 generally has a round cross-sectional shape. It should be understood, however, that other cross-sectional shapes, such as, but not limited to, square, triangular, oval and rectangular, could be used that accordingly correspond to the cross-sectional shape of the particular horizontal support member that is being used. While top attachment member 802 is depicted in FIGS. 8A and 8B as being integral with end cap 800, in an alternative exemplary embodiment, top attachment member 802 is separate from end cap 800 and is inserted into, for example, an aperture (not shown) in top portion 801. Further, while end cap 800 depicted in FIGS. 8A and 8B as extending from the top center of end cap 800, it should be understood that top attachment member 802 could be placed at another alternative location on end cap 800.

Bottom portion 803 is depicted in FIGS. 8A and 8B as being substantially cylindrical in shape in order to mate with a vertical pole member 105 having a substantially round cross-sectional shape by fitting inside the vertical pole member. Bottom portion 803 includes sloped ridges 805 that enable a convenient and affirmative press-fit or friction-fit mating between bottom portion 803 and the inside of a vertical pole member 105. It should be understood that other cross-sectional shapes could be used that accordingly correspond to the cross-sectional shape of the vertical pole member that is being used. In an alternative exemplary embodiment, the size and shape of bottom portion 503 could be selected to fit over the end of a vertical pole member 105. In one exemplary embodiment, bottom portion 803 also includes one or more tabs 806 having at least one aperture 807 that can be used for further securing end cap member 800 to a vertical pole member 105, such as by a bolt and nut arrangement or the like, and/or be used for attaching a tension member, such as disclosed in U.S. patent application Ser. No. 10/908,469, filed May 12, 2005, entitled "Recreational " Structure Using A Sleeve-Joint Coupling, and which is incorporated by reference herein. In one exemplary embodiment, such a tension member would extend through a vertical pole member 105 and be anchored, for example, to the ground in a well-known manner.

Figure 9A:
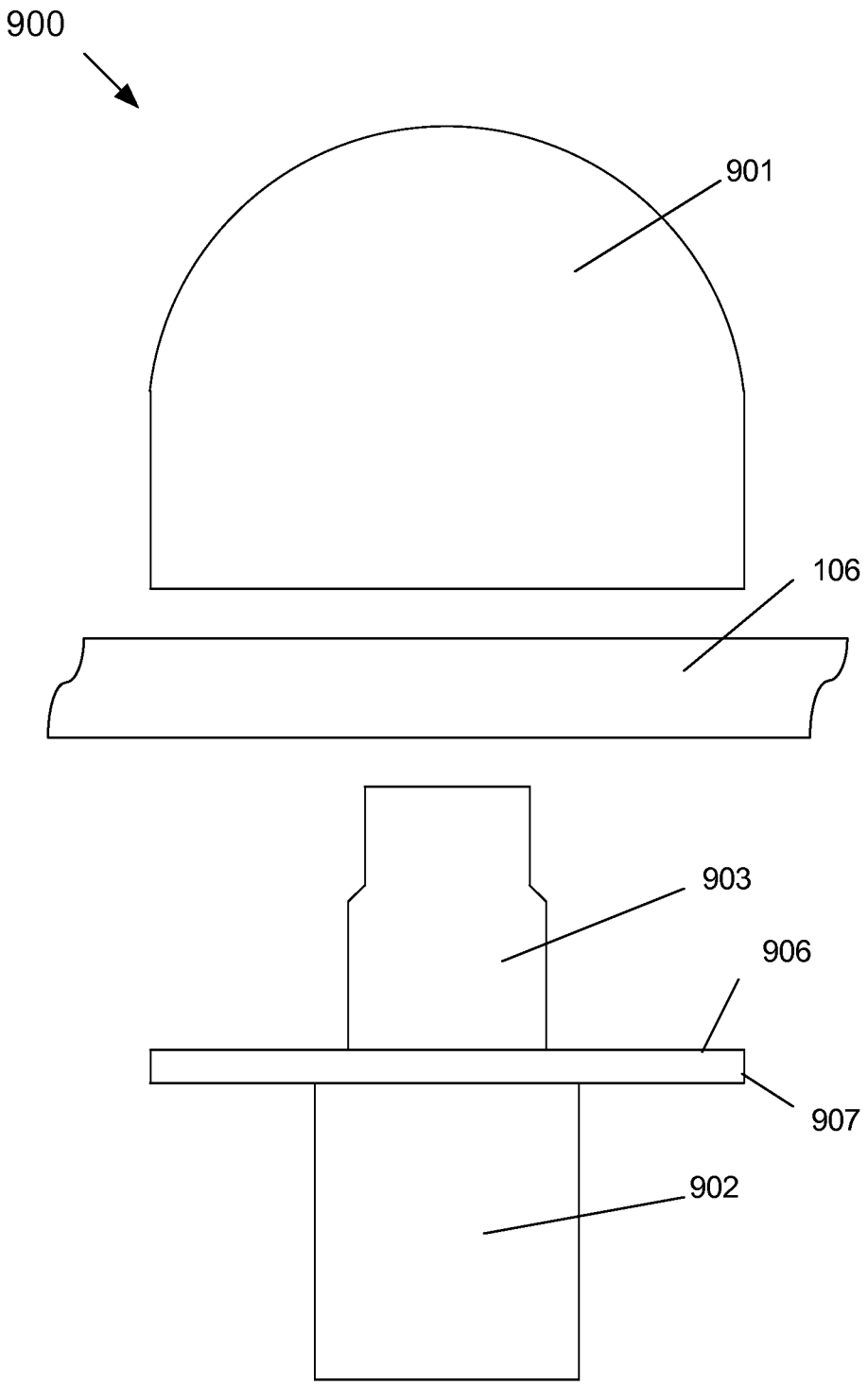
FIGS. 9A-9D depict a eighth exemplary embodiment of an end cap member according to the subject matter disclosed herein.
Figure 9B:
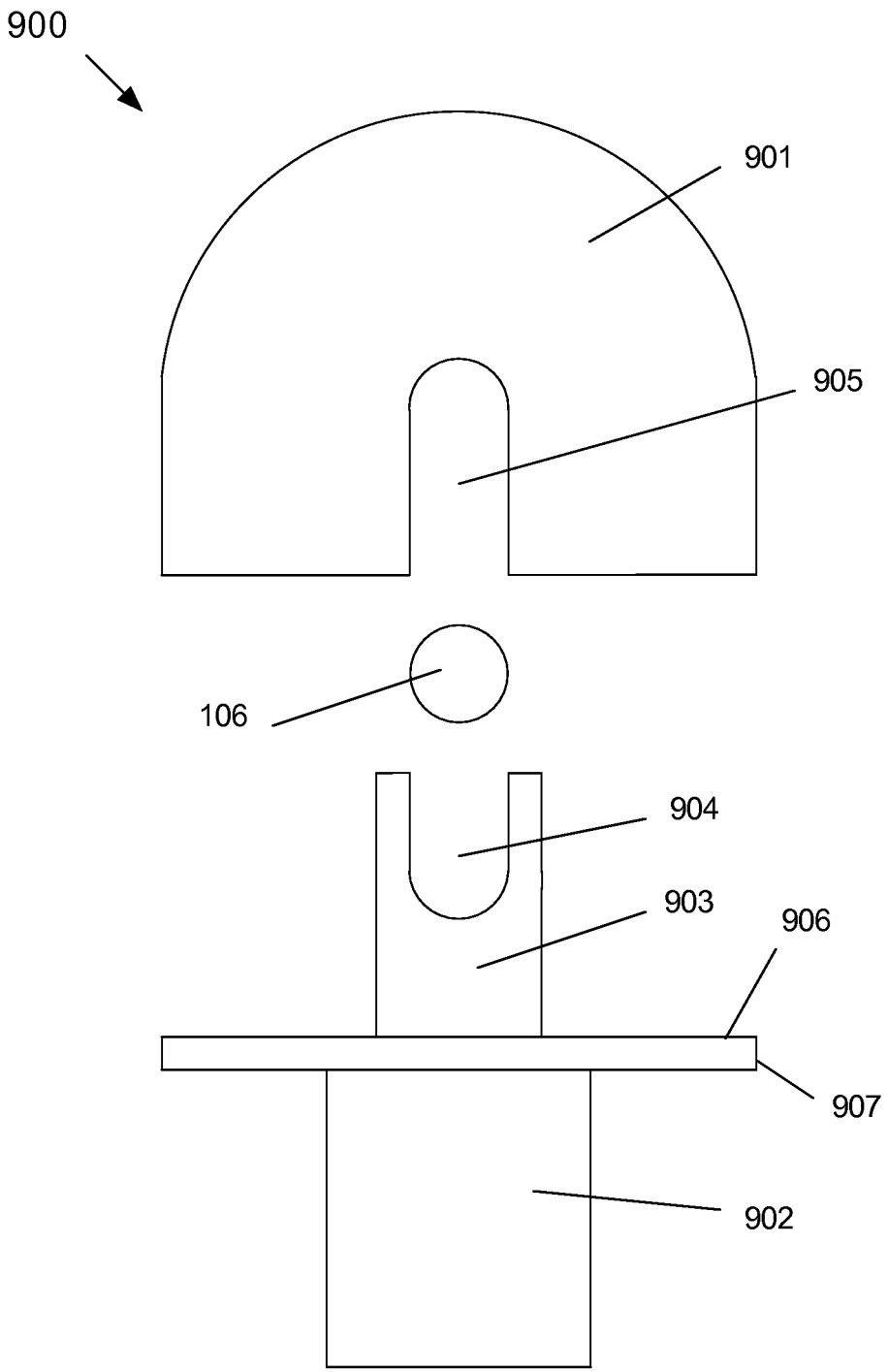
Figure 9C:
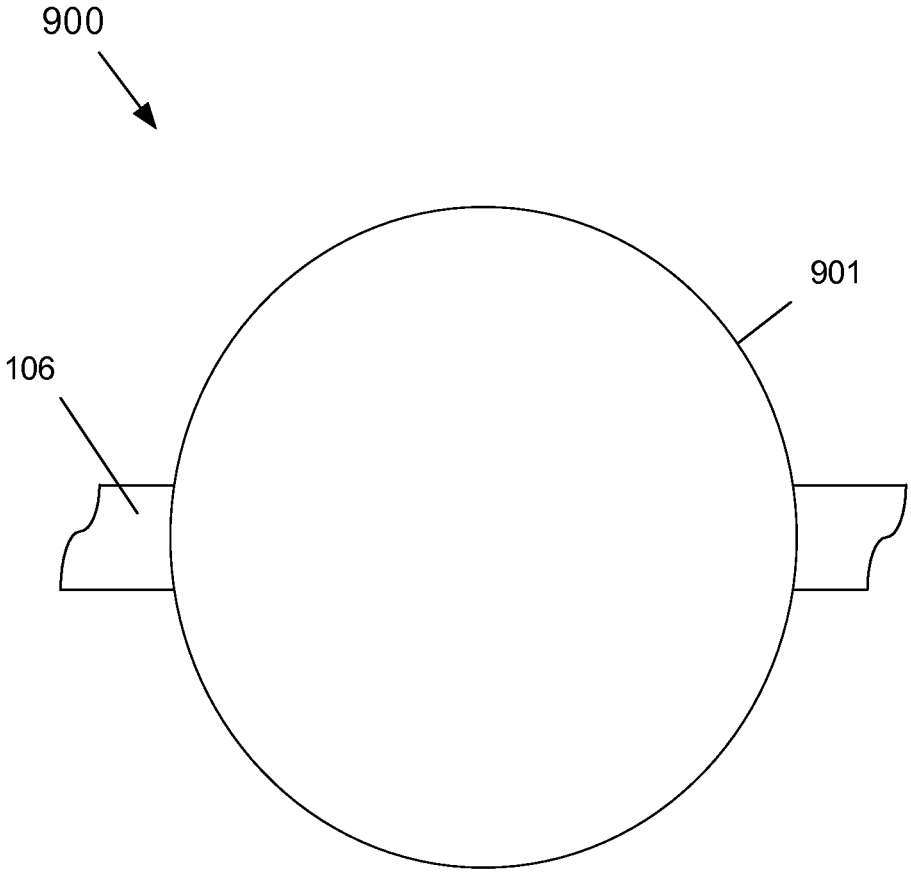
Figure 9D:
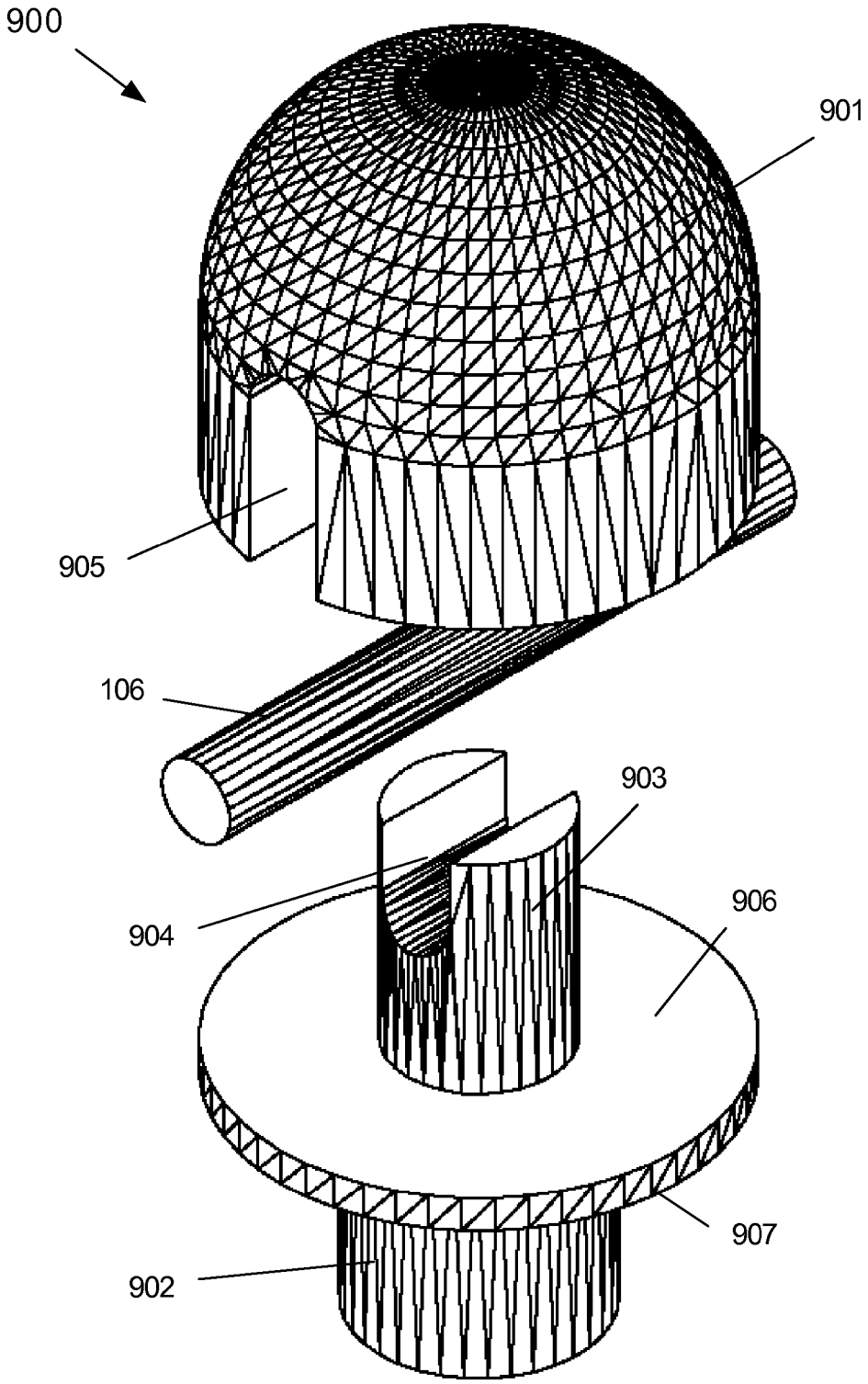

FIGS. 9A-9D depict an eighth exemplary embodiment of an end cap member 900 according to the subject matter disclosed herein. In particular, FIGS. 9A-9C respectively depict a first exploded side view, a second exploded side view and a top view of the fifth exemplary embodiment of end cap member 900 that is suitable for use with, for example, a trampoline safety enclosure according to the subject matter disclosed herein. FIG. 9D depicts a 3-D perspective exploded view of end cap member 900. End cap member 900 includes a top portion 901 and a bottom portion 902. Bottom portion 902 mates with a vertical pole member 105 (not shown in FIGS. 9A-9D) by fitting inside the vertical pole member. In an alternative exemplary embodiment, the size and shape of bottom portion 902 could be selected to fit over the end of a vertical pole member 105.

Bottom portion 902 includes a first member 903 having a slot 904 that functions as a holding mechanism that releasably receives a horizontal support member 106, a portion of which is shown in FIGS. 9A-9D. The cross-sectional shape of slot 904 is selected to correspond to the cross-sectional shape of horizontal support member 106. In one exemplary embodiment, top portion 901 has a smooth hemispherical shape that includes a slot opening 905 on opposite sides of top portion 901 so that when a horizontal support member 106 is received into slot 904 of first member 903, top portion 901 fits over horizontal support member 106 and first member 903 and contacts surface 906 of bottom portion 902. In one exemplary embodiment, the size of slot openings 905 is selected to closely correspond to the outside diameter of horizontal support member 106 in order to assist in keeping top portion 901 in place by a press fit or a friction fit around horizontal support member 106. In another exemplary embodiment, the size of top portion 901 is selected so that the internal surface of top portion 901 (not shown) contacts surface 907 of bottom portion 902 with a press fit or a friction fit.

Figure 10A:
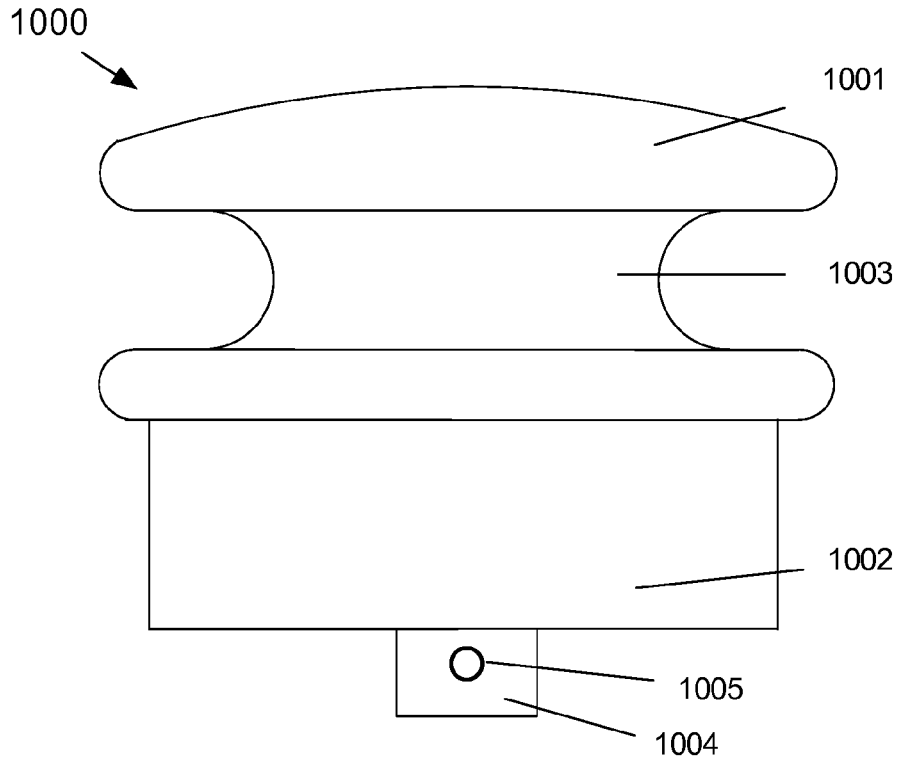
FIGS. 10A-10D depict a ninth exemplary embodiment of an end cap member according to the subject matter disclosed herein.
Figure 10B:
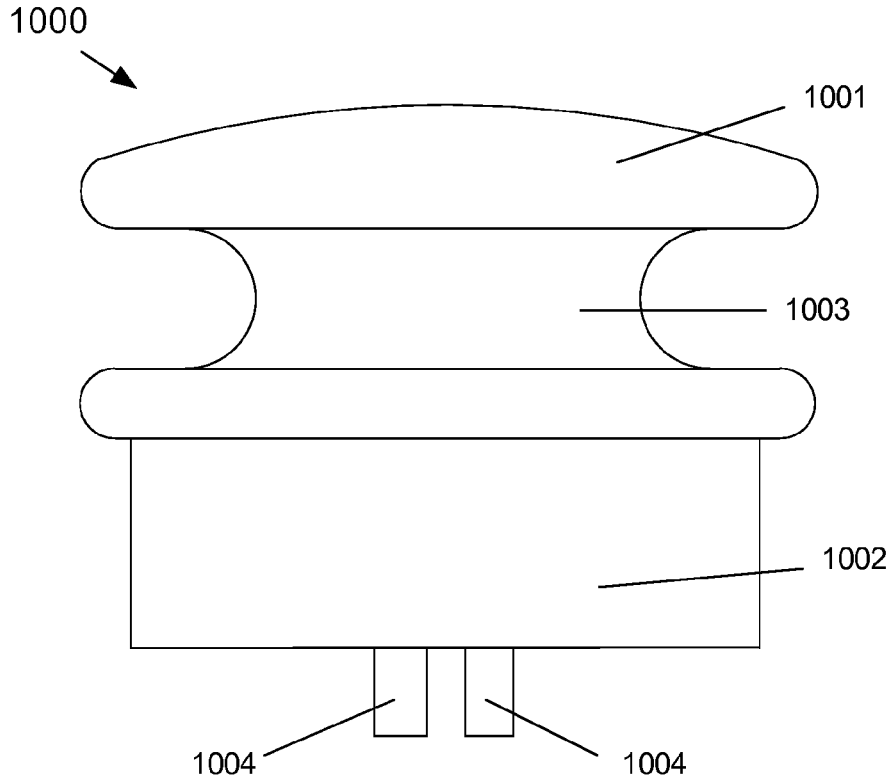
Figure 10C:
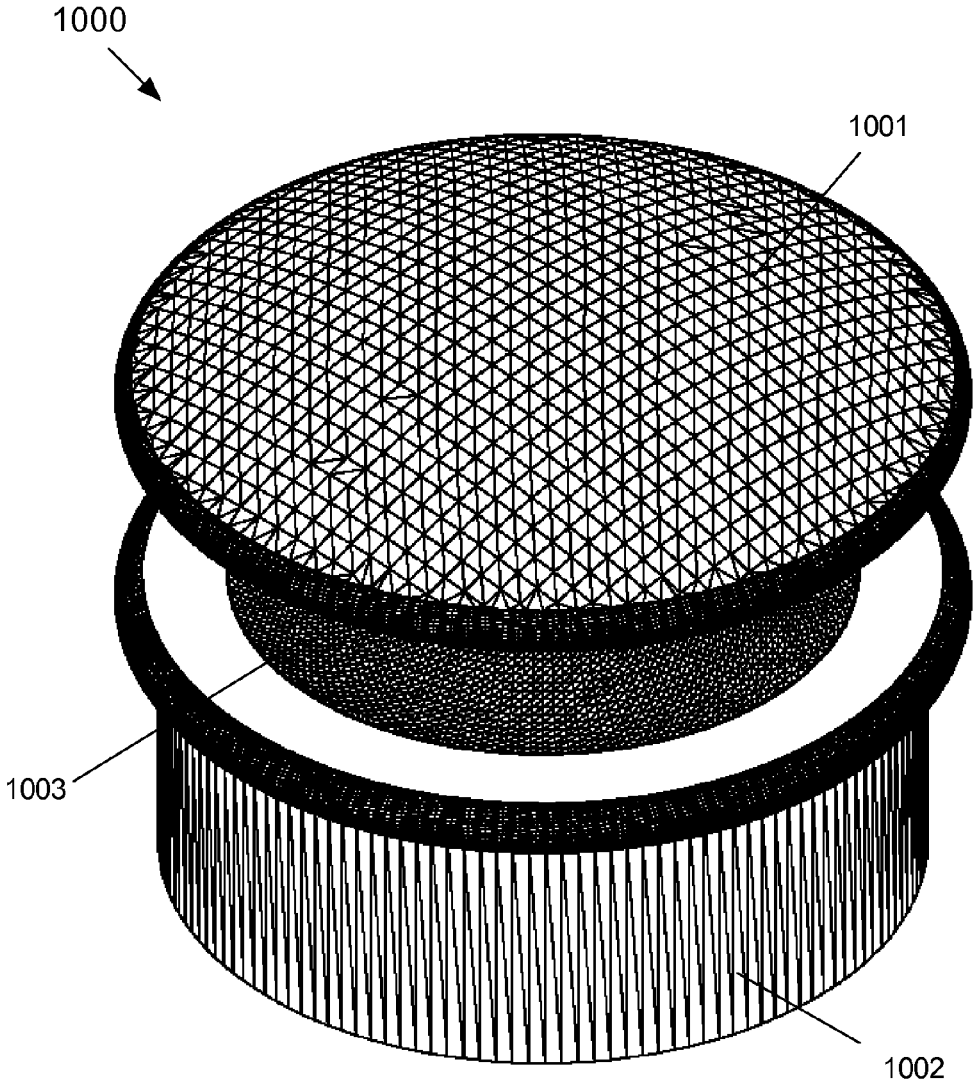
Figure 10D:
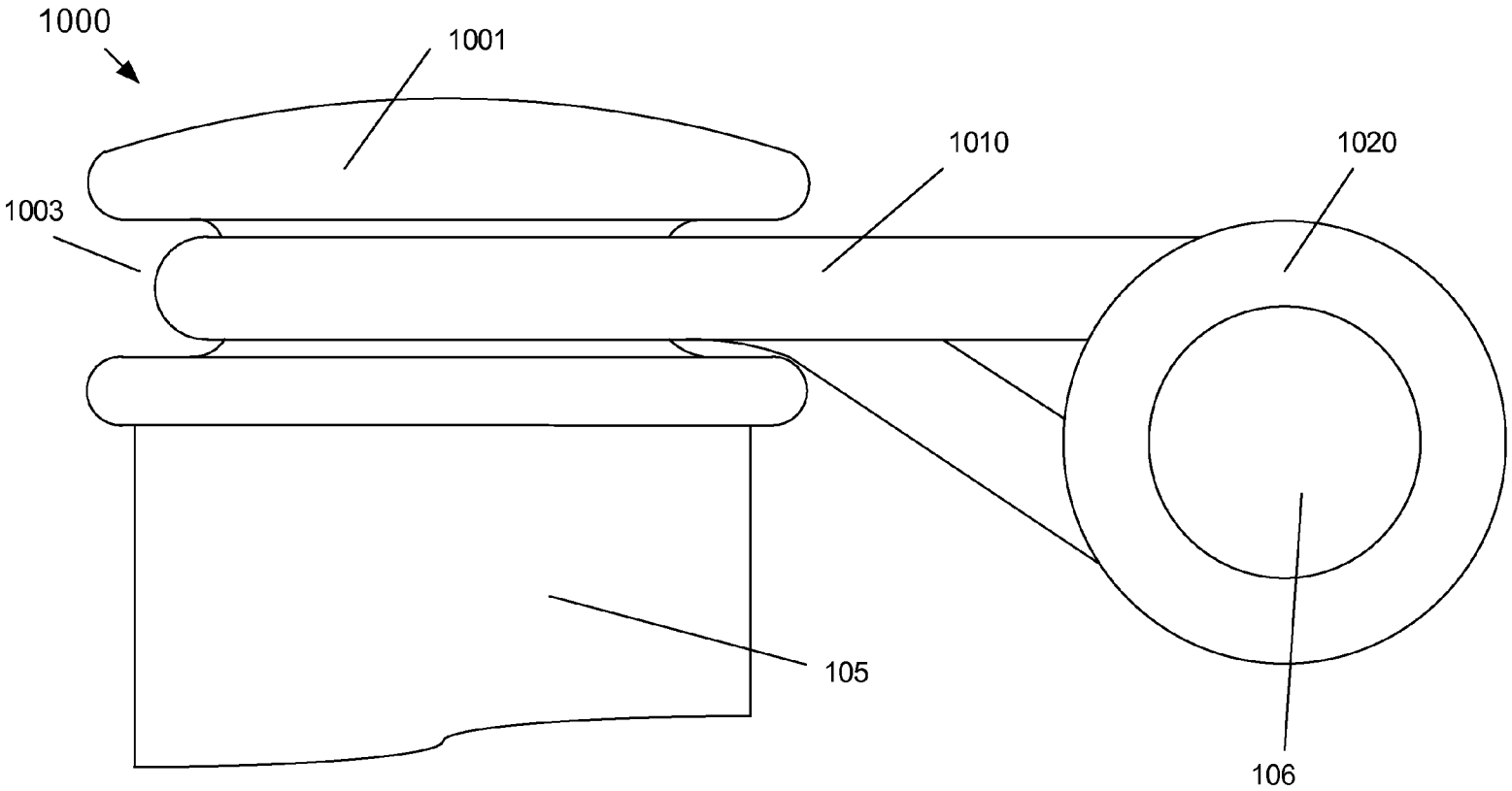

FIGS. 10A and 10B depict a ninth exemplary embodiment of an end cap member 1000 according to the subject matter disclosed herein. In particular, FIGS. 10A and 10B respectively depict a first side view and a second side view of the sixth exemplary embodiment of end cap member 1000 for use with, for example, a trampoline safety enclosure according to the subject matter disclosed herein. FIG. 10C depicts a 3-D perspective view of end cap member 1000. End cap member 1000 includes a top portion 1001, a bottom portion 1002, and a recessed portion 1003 that functions as a holding mechanism. Bottom portion 1002 mates with a vertical pole member 105 (not shown in FIGS. 10A and 10B) by fitting inside the vertical pole member. In an alternative exemplary embodiment, the size and shape of bottom portion 1002 could be selected to fit over the end of a vertical pole member 105. Recessed portion 1003 releasably receives an attachment device, such as an elastic cord, a bungee cord, a cord, a rope, a strap, a flexible webbing, or the like, that, in turn, releasably receives a horizontal support member 106 (not shown in FIGS. 10A and 10B). FIG. 10D depicts an exemplary embodiment of an end cap 1000 on the top of a vertical pole member 105. End cap member 1000 is depicted as receiving an attachment device 1010, which also engages an exemplary engagement member 1020 that is coupled in a well-known manner to a horizontal support member 106. In one exemplary embodiment, engagement member 1020 is separate from horizontal support member 106. In an alternative exemplary embodiment, the attachment device could be formed to be integral with the end cap member. In yet another exemplary embodiment, the attachment device can be integral to end cap member 1000. In still another exemplary embodiment, the attachment device can be integral to engagement member 1020.

In one exemplary embodiment, bottom portion 1002 also includes one or more tabs 1004 having at least one aperture 1005 that can be used for further securing end cap member 1000 to a vertical pole member 105, such as by a bolt and nut arrangement or the like, and/or be used for attaching a tension member, such as disclosed in U.S. patent application Ser. No. 10/908,469, filed May 12, 2005, entitled "Recreational " Structure Using A Sleeve-Joint Coupling, and which is incorporated by reference herein. In one exemplary embodiment, such a tension member would extend through a vertical pole member 105 and be anchored, for example, to the ground in a well-known manner.

Figure 11A:
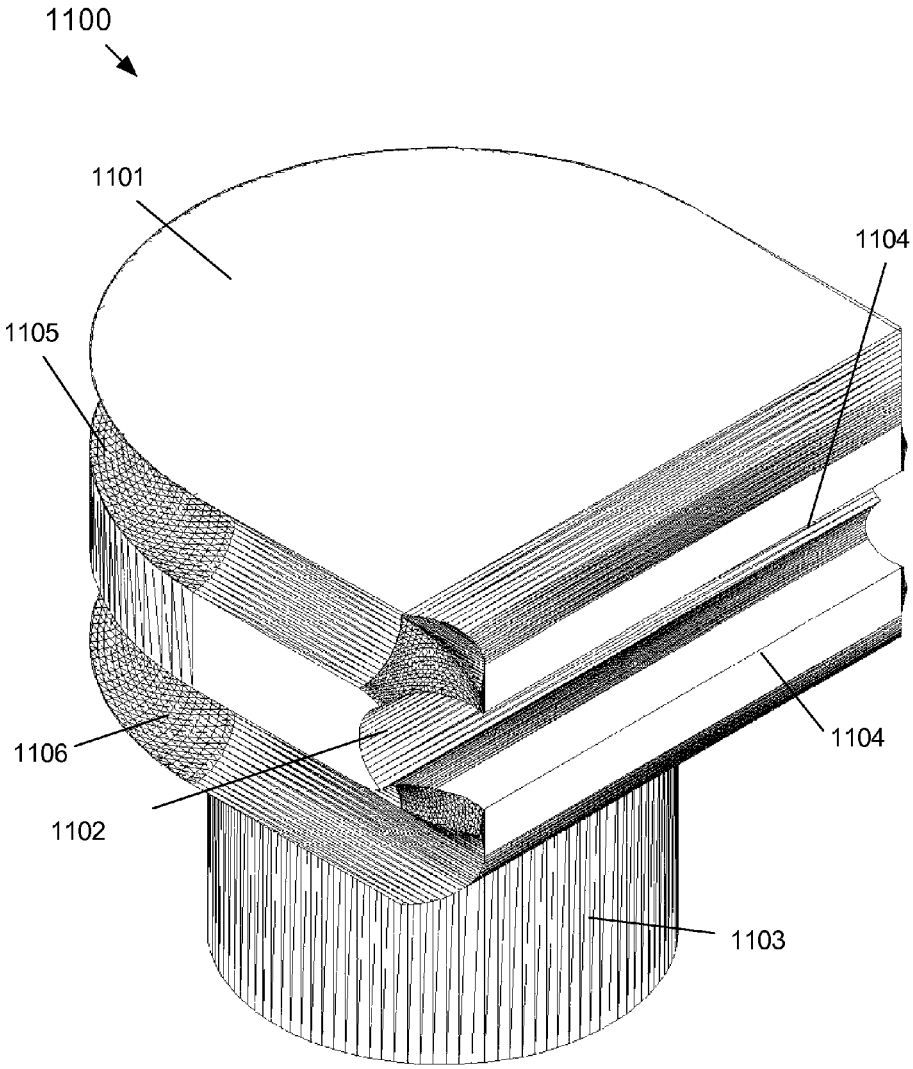
FIGS. 11A and 11B depict a tenth exemplary embodiment of end cap member according to the subject matter disclosed herein.
Figure 11B:
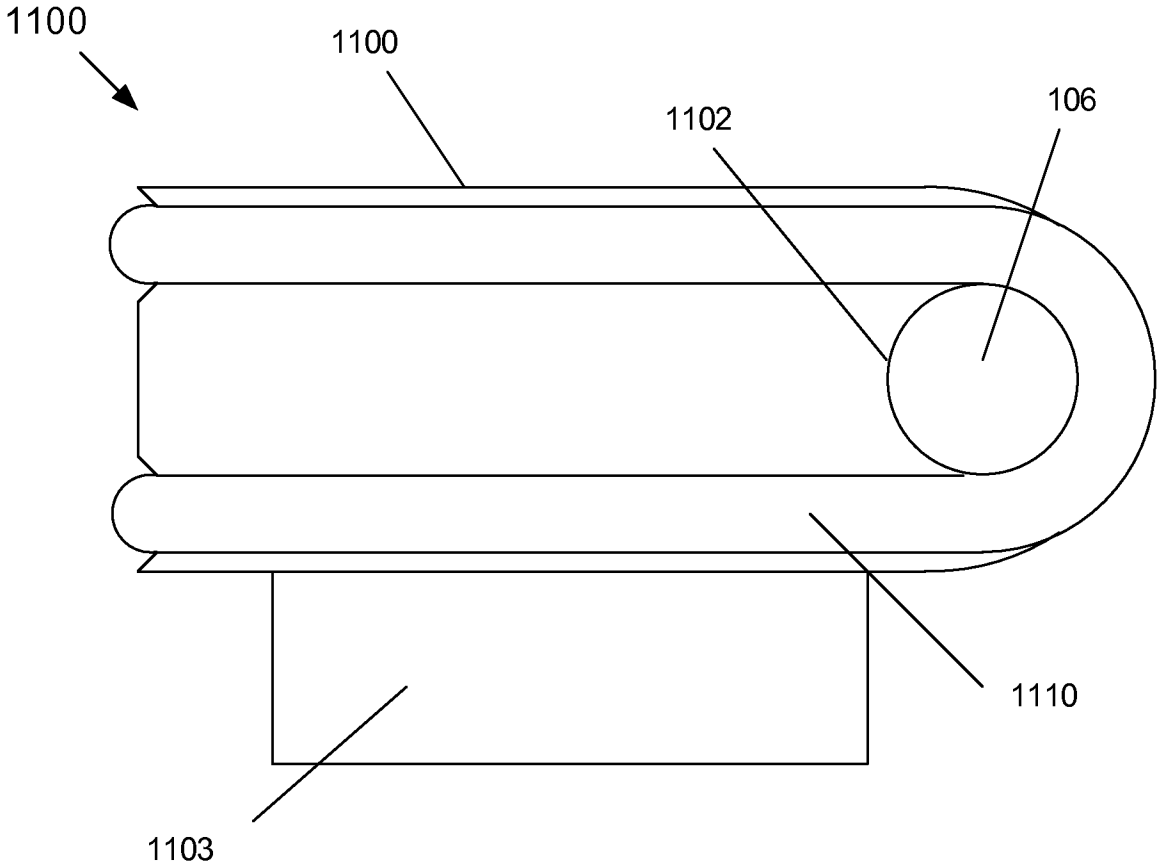

FIGS. 11A and 11B depict a tenth exemplary embodiment of end cap member 1100 according to the subject matter disclosed herein. In particular, FIG. 11A depicts a 3-D-dimensional perspective view of end cap member 1100. End cap member 1100 includes a top portion 1101 having a side slot, or groove, 1102, and a bottom portion 1103. Bottom portion 1103 fits inside a vertical pole member 105 (not shown in FIGS. 11A and 11B).

Side slot 1102 provides a holding mechanism that releasably receives a horizontal support member 106 (shown in FIG. 11B). The cross-sectional shape of side slot 1102 corresponds to the cross-sectional shape of the particular horizontal support member 106 being used. For example, in FIGS. 11A and 11B, the cross-sectional shape of side slot 1102 is substantially round and corresponds to a horizontal support member 106 that also has a substantially round cross-sectional shape. Side slot 1102 also includes edges 1104 that are spaced apart a distance that is selected to be less that the diameter of a horizontal support member 106 so that a received horizontal support member 106 is held in side slot 1102. It should be understood that side slot 1102 could have other cross-sectional shapes that accordingly correspond to the cross-sectional shape of the particular horizontal support member 106 being used.

One exemplary embodiment of end cap member 1100 also includes slots, or grooves, 1105 and 1106 that receive an attachment member for further affirmatively holding a horizontal support member 106 in side slot 1102. FIG. 11B depicts a side view of an exemplary embodiment of an end cap 1100 receiving a horizontal support member 106 and utilizing an attachment device 1110 for affirmatively holding horizontal support member 106 in side slot 1102. In one exemplary embodiment, attachment device is a continuous loop made from an elastic-type material, such as an elastic cord, a bungee cord, a cord, a rope, a strap, a flexible webbing or the like.

Bottom portion 1103 is depicted in FIGS. 11A and 11B as being substantially cylindrical in shape in order to mate with vertical pole member 105 having a substantially round cross-sectional shape by fitting inside the vertical pole member. Bottom portion 1103 can include sloped ridges that enable a convenient and affirmative press-fit or friction-fit mating between bottom portion 1103 and the inside of a vertical pole member 105. It should be understood that bottom portion 1103 could have other cross-sectional shapes that accordingly correspond to the cross-sectional shape of the particular vertical pole member that is being used. In an alternative exemplary embodiment, the size and shape of bottom portion 1103 could be selected to fit over the end of a vertical pole member 105 as opposed to fitting inside the vertical pole member 105. In one exemplary embodiment, bottom portion 1103 could also include one or more tabs having at least one aperture that can be used for further securing end cap member 1100 to a vertical pole member 105, such as by a bolt and nut arrangement or the like, and/or be used for attaching a tension member, such as disclosed in U.S. patent application Ser. No. 10/908,469, filed May 12, 2005, entitled "Recreational " Structure Using A Sleeve-Joint Coupling, and which is incorporated by reference herein. In one exemplary embodiment, such a tension member would extend through a vertical pole member 105 and be anchored, for example, to the ground in a well-known manner.

Figure 12:
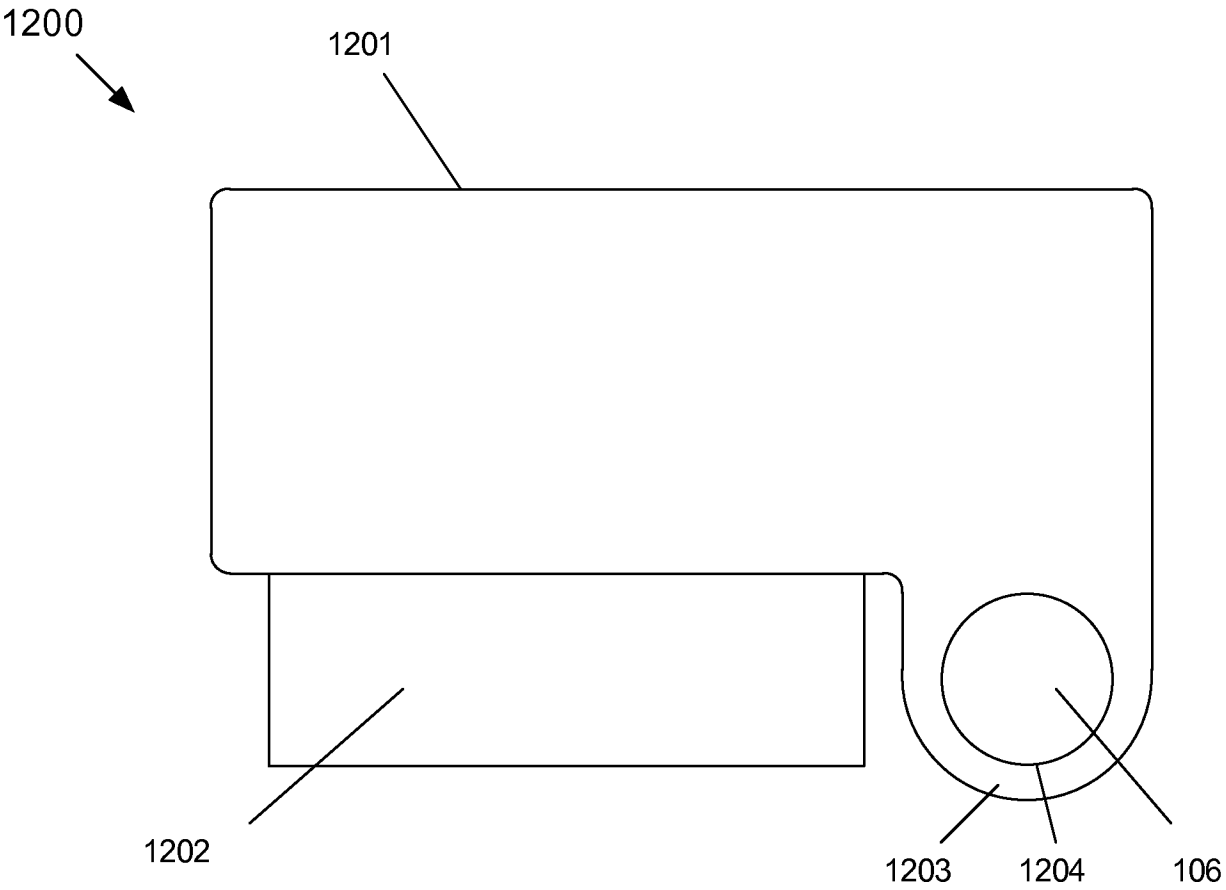
FIG. 12 depicts an eleventh exemplary embodiment of end cap member according to the subject matter disclosed herein.

FIG. 12 depicts an eleventh exemplary embodiment of end cap member 1200 according to the subject matter disclosed herein. In particular, FIG. 12 depicts a side view of an end cap member 1200. End cap member 1200 includes a top portion 1201 a bottom portion 1202 and an attachment member 1203 shaped substantially like a closed ring that functions as a holding mechanism. Alternatively, attachment member 1203 could be shaped substantially like an open ring that functions as a holding mechanism. Bottom portion 1202 fits inside a vertical pole member 105 (not shown in FIG. 12).

Attachment member 1203 releasably receives a horizontal support member 106 in space 1204 by horizontal support member 106 passing through space 1204. Space 1204 of attachment member 1203 is shaped to correspond to the cross-sectional shape of a horizontal support member 106. As depicted in FIG. 12, space 1204 generally has a substantially round cross-sectional shape. It should be understood that other cross-sectional shapes could be used that accordingly correspond to the cross-sectional shape of the particular horizontal support member that is being used. While attachment member 1203 is depicted as being substantially oriented for releasably receiving a portion of a horizontal support member 106 or a coupling member attached to a horizontal support member 106, it should be understood that attachment member 1203 could be oriented to releasably receive a portion of horizontal support member that is not oriented substantially horizontally or another coupling member that is coupled to a horizontal support member. Further, while attachment member 1203 is depicted as being positioned substantially below top portion 1201, it should be understood that attachment member 1203 could be positioned on the side of top portion 1201. As yet another alternative, space 1204 could receive an coupling device, such as an elastic cord, a bungee cord, a cord, a rope, a strap, a flexible webbing, or the like, that, in turn, releasably receives a horizontal support member 106.

Bottom portion 1202 is depicted in FIG. 12 as being substantially cylindrical in shape in order to mate with a vertical pole member 105 (not shown in FIG. 12) having a substantially round cross-sectional shape by fitting inside the vertical pole member. Bottom portion 1202 could also include sloped ridge that enable a convenient and affirmative press-fit or friction-fit mating between bottom portion 1202 and the inside of a vertical pole member 105. It should be understood that bottom portion 1202 could have other cross-sectional shapes that accordingly correspond to the cross-sectional shape of the particular vertical pole member that is being used. In an alternative exemplary embodiment, the size and shape of bottom portion 1202 could be selected to fit over the end of a vertical pole member 105 as opposed to fitting inside the vertical pole member 105. In one exemplary embodiment, bottom portion 1202 could also include one or more tabs having at least one aperture that can be used for further securing end cap member 1200 to a vertical pole member 105, such as by a bolt and nut arrangement or the like, and/or be used for attaching a tension member, such as disclosed in U.S. patent application Ser. No. 10/908,469, filed May 12, 2005, entitled "Recreational " Structure Using A Sleeve-Joint Coupling, and which is incorporated by reference herein. In one exemplary embodiment, such a tension member would extend through a vertical pole member 105 and be anchored, for example, to the ground in a well-known manner.

Figure 13A:
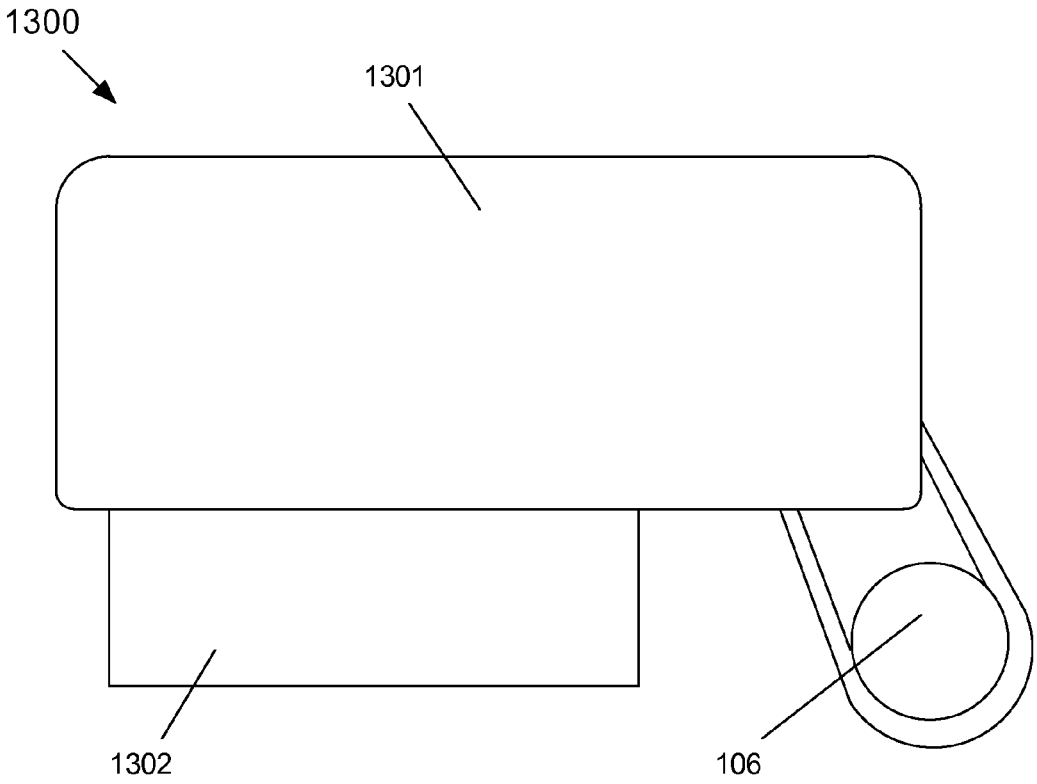
FIGS. 13A and 13B depicts a twelfth exemplary embodiment of end cap member according to the subject matter disclosed herein.
Figure 13B:
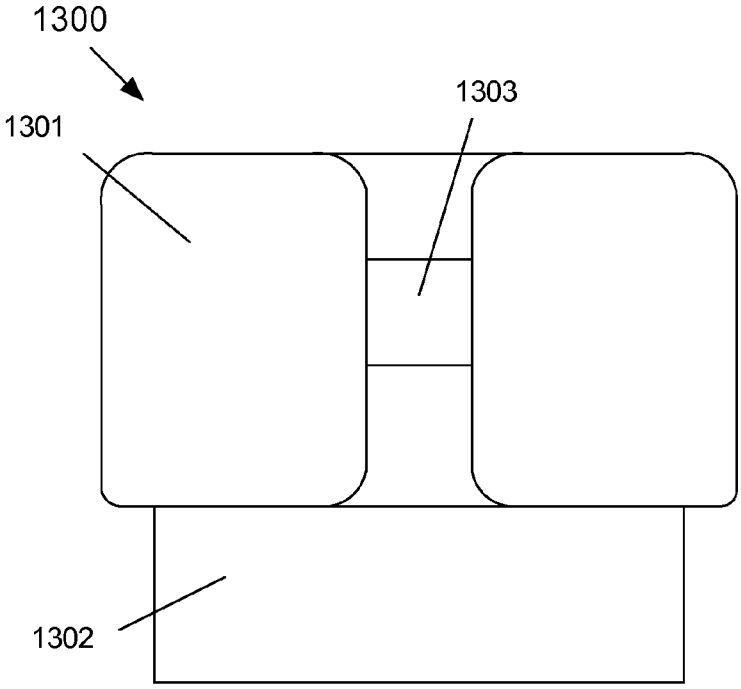

FIGS. 13A and 13B depicts a twelfth exemplary embodiment of end cap member 1300 according to the subject matter disclosed herein. In particular, FIG. 13A depicts a first side view of an end cap member 1300 and FIG. 13B depicts a second side view of end cap member 1300. End cap member 1300 includes atop portion 1301 a bottom portion 1302 and an attachment member 1303 (FIG. 13B) that function with an attachment device 1304 as a holding mechanism for a horizontal support member 106. Bottom portion 1302 fits inside a vertical pole member 105 (not shown in FIG. 13).

Attachment member 1303 (FIG. 13B) and attachment device 1304 (FIG. 13A) releasably receives a horizontal support member 106. Attachment device 1304 can be, for example, an elastic cord, a bungee cord, a cord, a rope, a strap, a flexible webbing, or the like, that is coupled to attachment member 1304, in turn, releasably receives a horizontal support member 106.

Bottom portion 1302 is depicted in FIGS. 13A and 13B as being substantially cylindrical in shape in order to mate with a vertical pole member 105 (not shown in FIGS. 13A and 13B) having a substantially round cross-sectional shape by fitting inside the vertical pole member. Bottom portion 1302 could also include sloped ridge that enable a convenient and affirmative press-fit or friction-fit mating between bottom portion 1302 and the inside of a vertical pole member 105. It should be understood that bottom portion 1302 could have other cross-sectional shapes that accordingly correspond to the cross-sectional shape of the particular vertical pole member that is being used. In an alternative exemplary embodiment, the size and shape of bottom portion 1302 could be selected to fit over the end of a vertical pole member 105 as opposed to fitting inside the vertical pole member 105. In one exemplary embodiment, bottom portion 1302 could also include one or more tabs having at least one aperture that can be used for further securing end cap member 1300 to a vertical pole member 105, such as by a bolt and nut arrangement or the like, and/or be used for attaching a tension member, such as disclosed in U.S. patent application Ser. No. 10/908, 469, filed May 12, 2005, entitled "Recreational " Structure Using A Sleeve-Joint Coupling, and which is incorporated by reference herein . In one exemplary embodiment, such a tension member would extend through a vertical pole member 105 and be anchored, for example, to the ground in a well-known manner.

Figure 14A:
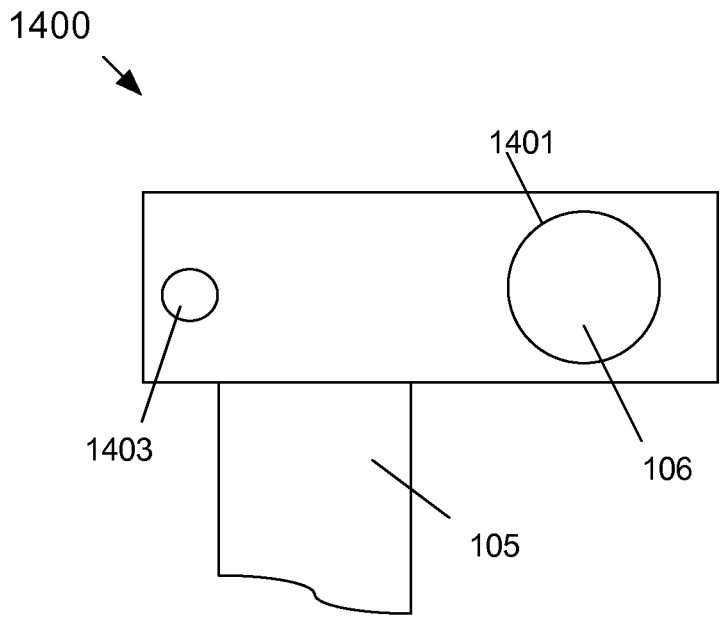
FIGS. 14A and 14B depicts a thirteenth exemplary embodiment of end cap member according to the subject matter disclosed herein.
Figure 14B:
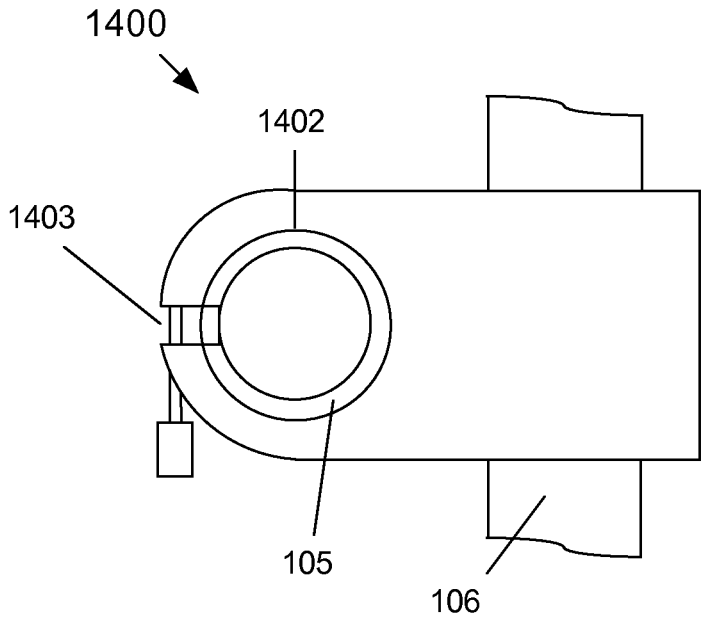

FIGS. 14A and 14B depicts a thirteenth exemplary embodiment of end cap member 1400 according to the subject matter disclosed herein. In particular, FIG. 14A depicts a side view of an end cap member 1400 and FIG. 14B depicts a top view of end cap member 1400. End cap member 1400 includes a first aperture 1401 that functions as a holding mechanism and releasably receives a horizontal support member 106, and a second aperture that receives a vertical pole member 105. Aperture 1402 receives a vertical pole member 105. Tightening mechanism 1403 is used for clamping end cap member 1400 in a well-known manner to the top of or near the top of vertical pole member 105. It should be understood that other embodiments of a tightening mechanism could be used. Further, end cap member 1400 could be formed to be integral with a vertical pole member 105.

Aperture 1401 releasably receives a horizontal support member 106 by horizontal support member 106 passing through aperture 1401. Aperture 1401 is shaped to correspond to the cross-sectional shape of a horizontal support member 106. As depicted in FIG. 14A, space 1204 generally has a substantially round cross-sectional shape. It should be understood that other cross-sectional shapes could be used that accordingly correspond to the cross-sectional shape of the particular horizontal support member that is being used. While aperture 1401 is depicted as being substantially oriented for releasably receiving a portion of a horizontal support member 106 or a coupling member attached to a horizontal support member 106, it should be understood that aperture 1401 could be oriented to releasably receive a portion of horizontal support member that is not oriented substantially horizontally or another coupling member that is coupled to a horizontal support member. As an alternative, aperture 1401 could receive an coupling device, such as an elastic cord, a bungee cord, a cord, a rope, a strap, a flexible webbing, or the like, that, in turn, releasably receives a horizontal support member 106. As yet another exemplary embodiment, end cap member 1400 could be formed to include a bracket that releasably receives a horizontal support member 106.

Figure 15A:
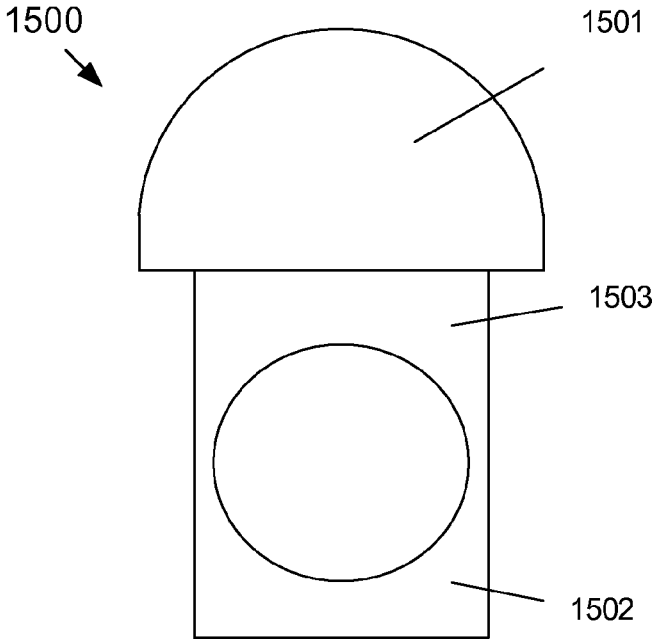
FIGS. 15A and 15B depicts a fourteenth exemplary embodiment of end cap member according to the subject matter disclosed herein.
Figure 15B:
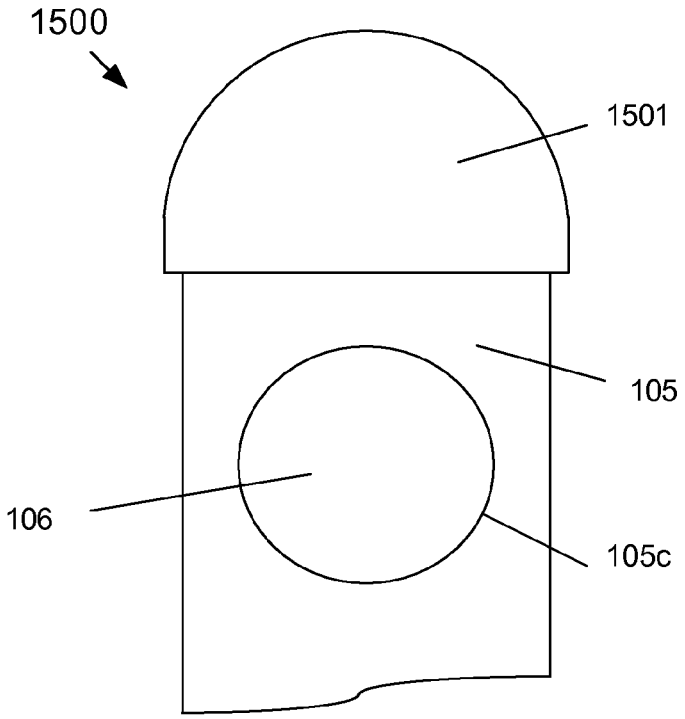

FIGS. 15A and 15B depicts a fourteenth exemplary embodiment of end cap member 1500 according to the subject matter disclosed herein. In particular, FIG. 15A depicts a side view of an end cap member 1500 and FIG. 15B depicts a side view of an end cap member 1500 on a vertical pole member 105. End cap member 1500 includes a top portion 1501, a bottom portion 1502 and an aperture 1503 that functions as a holding mechanism and releasably receives a horizontal support member 106. In one exemplary embodiment, end cap member 1500 could be formed to be integral with a vertical pole member 105.

Aperture 1503 releasably receives a horizontal support member 106 in aperture 1503 by end cap member 1500 being placed in a vertical pole member 105 and a horizontal support member 106 passing through aperture 1503 in end cap member 1500 and aperture 105*c* in vertical pole member 105 (FIG. 15B). Apertures 1503 and 105*c* are shaped to correspond to the cross-sectional shape of a horizontal support member 106. As depicted in FIGS. 15A and 15B, aperture 1503 and aperture 105*c* generally have a substantially round cross-sectional shape. It should be understood that other cross-sectional shapes could be used that accordingly correspond to the cross-sectional shape of the particular horizontal support member that is being used. While apertures 1503 and 105*c* are depicted as being substantially oriented for releasably receiving a portion of a horizontal support member 106 or a coupling member attached to a horizontal support member 106, it should be understood that apertures 1503 and 105*c* could be oriented to releasably receive a portion of horizontal support member that is not oriented substantially horizontally or another coupling member that is coupled to a horizontal support member. As yet another alternative, apertures 1503 and 105*c* could receive an coupling device, such as an elastic cord, a bungee cord, a cord, a rope, a strap, a flexible webbing, or the like, that, in turn, releasably receives a horizontal support member 106. In yet another exemplary embodiment, only vertical pole member 105 has a aperture 105*c* for releasably receiving a horizontal support member 106.

Bottom portion 1502 is depicted in FIG. 15A as being substantially cylindrical in shape in order to mate with a vertical pole member 105 (FIG. 15B) having a substantially round cross-sectional shape by fitting inside the vertical pole member. Bottom portion 1502 could also include sloped ridge that enable a convenient and affirmative press-fit or friction-fit mating between bottom portion 1502 and the inside of a vertical pole member 105. It should be understood that bottom portion 1502 could have other cross-sectional shapes that accordingly correspond to the cross-sectional shape of the particular vertical pole member that is being used. In an alternative exemplary embodiment, the size and shape of bottom portion 1502 could be selected to fit over the end of a vertical pole member 105 as opposed to fitting inside the vertical pole member 105. In one exemplary embodiment, bottom portion 1502 could also include one or more tabs having at least one aperture that can be used for further securing end cap member 1500 to a vertical pole member 105, such as by a bolt and nut arrangement or the like, and/or be used for attaching a tension member, such as disclosed in U.S. patent application Ser. No. 10/908,469, filed May 12, 2005, entitled "Recreational " Structure Using A Sleeve-Joint Coupling, and which is incorporated by reference herein . In one exemplary embodiment, such a tension member would extend through a vertical pole member 105 and be anchored, for example, to the ground in a well-known manner.

While exemplary trampoline 100 shown in FIGS. 1A and 1B are depicted as being round, it should be understood that the subject matter disclosed herein could be used with a trampoline and safety enclosure having a different shape, such as square, rectangular, oval or polygonal. Further, while exemplary trampoline 100, 100' and exemplary safety enclosure 101, 101' shown in FIGS. 1A and 1B are depicted as having eight vertical frame members 103 and eight vertical pole members 105, it should be understood that trampolines 100, 100' can have any number of vertical frame members 103 and safety enclosures 101, 101' can have any number of vertical pole members 105. Additionally, the end cap member of the subject matter disclosed herein can be made from any suitable material that has sufficient strength to bear the loads and stresses that are associated with trampolines, such as metals, plastics, wood, ceramics or the like. Further still, while the end cap members of the subject matter disclosed herein have been described as having a generally round cross-section shape in order to mate with a vertical pole member, it should be understood that an end cap member according to the subject matter disclosed herein could have a cross-sectional shape that corresponds to the shape of the vertical pole member. Further, at least one end cap member could be formed to be integral with a vertical pole member 105.

As yet another exemplary alternative embodiment, one or more safety enclosure vertical pole members 105, horizontal support members 106 and end cap members could be configured to form an arch, or an arc shape, between two or more frame members 103. The two frame members 103 could be adjacent or could be separated by one or more other frame members 103. As another exemplary alternative embodiment, a horizontal support member could be connected between adjacent peaks of an arch in a substantially inflexible manner as described herein.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope. Accordingly, the present embodiments are to be considered as illustrative and not restrictive, and the subject matter disclosed herein is not to be limited to the details given herein, but may be modified within the scope and equivalents of the appended claims.

What is claimed is:

1. A frame structure for a safety enclosure for a recreational structure, comprising:

at least one tubular horizontal support member for supporting a discrete piece of netting-type material for enclosing a safety enclosure space, the at least one horizontal support member being independently bendable and resiliently flexible to resist bending and having an outer wall;

at least one vertical pole member, the at least one vertical pole member comprising a top end with an outer wall; and at least one end cap member including a mating portion for friction mating with the outer wall of the top end of the at least one vertical pole member and a receptacle for releasably receiving and supporting the outer wall of the at least one horizontal support member.

2. The frame structure according to claim 1, wherein the at least one end cap member is integral with the top end of at least one vertical pole member.

3. The frame structure according to claim 1, wherein the receptacle of the at least one end cap member comprises a slot for releasably receiving the outer wall of the at least one horizontal support member.

4. The frame structure according to claim 3, wherein the slot is substantially on a top portion of the at least one end cap member.

5. The frame structure according to claim 1, wherein the receptacle of the at least one end cap member comprises an aperture that is capable of releasably receiving the outer wall of the at least one horizontal support member within the aperture.

6. The frame structure according to claim 1, wherein the at least one end cap member comprises a top attachment member including the receptacle for releasably receiving the outer wall of the at least one horizontal support member.

7. The frame structure according to claim 1, wherein the at least one vertical pole member comprises part of the safety enclosure.

8. The frame structure according to claim 1, further comprising a netting-type material attached to one of the at least one horizontal support member and the at least one end cap member, the netting-type material enclosing the safety enclosure space.

9. The frame structure according to claim 1, wherein the at least one horizontal support member is made out of a material, the material being at least one of aluminum, steel, metal alloy, plastic, carbon fiber, and wood.

10. A frame structure for a safety enclosure for a recreational structure, comprising:

at least one tubular horizontal support member, the at least one horizontal support member having an outer wall and being independently bendable and resiliently flexible to resist bending;

at least one vertical pole member comprising a top end having an outer wall and at least one end cap member including a receptacle for releasably receiving and supporting the outer wall of the at least one horizontal support member, the at least one end cap member including a mating portion for engaging the outer wall of the at least one vertical pole member; and a discrete piece of netting-type material attached to the at least one horizontal support member, the discrete piece of netting-type material forming a safety enclosure space.

11. The frame structure according to claim 10, wherein the receptacle of the at least one end cap member comprises a slot for releasably receiving the outer wall of the at least one horizontal support member.

12. The frame structure according to claim 11, wherein the slot is substantially on a top portion of the at least one end cap member.

13. The frame structure according to claim 10, wherein the receptacle of the at least one end cap member comprises an aperture that is capable of releasably receiving the outer wall of the at least one horizontal support member.

14. The frame structure according to claim 10, wherein the at least one end cap member comprises a top attachment member including the receptacle for releasably receiving the outer wall of the at least one horizontal support member.

15. The frame structure according to claim 10, wherein the at least one vertical pole member comprises part of the safety enclosure.

16. The frame structure according to claim 10, wherein the at least one horizontal support member is made out of a material, the material being at least one of aluminum, steel, metal alloy, plastic, carbon fiber, and wood.

* * * * *